US009528782B2

(12) United States Patent
Meier

(10) Patent No.: US 9,528,782 B2
(45) Date of Patent: Dec. 27, 2016

(54) FIREARM SYSTEM AND METHODS OF ASSEMBLY AND DISASSEMBLY

(71) Applicant: Michael Meier, Thornton, CO (US)

(72) Inventor: Michael Meier, Thornton, CO (US)

(73) Assignee: Helvetic Design Corporation, Thornton, CO (US)

( * ) Notice: Subject to any disclaimer, the term of this patent is extended or adjusted under 35 U.S.C. 154(b) by 0 days.

(21) Appl. No.: 14/815,291

(22) Filed: Jul. 31, 2015

(65) Prior Publication Data

US 2016/0033219 A1 Feb. 4, 2016

Related U.S. Application Data

(60) Provisional application No. 62/032,122, filed on Aug. 1, 2014, provisional application No. 62/066,045, filed (Continued)

(51) Int. Cl.

| | |
|---|---|
| ***F41A 3/66*** | (2006.01) |
| ***F41A 3/72*** | (2006.01) |
| ***F41A 5/18*** | (2006.01) |
| ***F41A 11/00*** | (2006.01) |
| ***F41A 17/38*** | (2006.01) |
| ***F41A 19/06*** | (2006.01) |
| ***F41A 19/10*** | (2006.01) |

(Continued)

(52) U.S. Cl.

CPC .. *F41A 3/66* (2013.01); *F41A 3/72* (2013.01); *F41A 5/18* (2013.01); *F41A 11/00* (2013.01); *F41A 17/38* (2013.01); *F41A 19/06* (2013.01); *F41A 19/10* (2013.01); *F41A 19/12* (2013.01); *F41A 19/14* (2013.01); *F41C 23/04* (2013.01); *F41C 23/16* (2013.01); *F41C 23/20* (2013.01)

(58) Field of Classification Search

CPC ..... F41A 3/66; F41A 5/18–5/28; F41A 11/00; F41C 23/20

See application file for complete search history.

(56) References Cited

U.S. PATENT DOCUMENTS 5,522,166 A * 6/1996 Martel ..... F41G 11/003 42/124
5,900,577 A * 5/1999 Robinson ..... F41A 11/02 89/156

(Continued)

*Primary Examiner* — Stephen M Johnson
*Assistant Examiner* — Joshua Semick
(74) *Attorney, Agent, or Firm* — Smith Moore Leatherwood LLP; Thomas W. Epting

(57) ABSTRACT

A firearm is described herein. The firearm comprises a receiver assembly adapted to receive a cartridge, a bolt assembly including a firing device operable to fire the cartridge, a barrel adapted to receive the projectile after the cartridge is fired, and a gas assembly including a gas tube. The receiver assembly includes an upper receiver portion, a lower receiver portion, and an upper receiver cover. The upper receiver portion defines a longitudinal axis, and an indexing slot operable to receive the gas tube. The upper receiver portion includes at least one integrated exterior track extending generally parallel to the longitudinal axis adapted to slidably couple with the upper receiver cover and a plurality of interior tracks extending generally parallel to the longitudinal axis adapted to slidably couple with the bolt assembly. The upper and lower receiver portions are pivotally connected to one another.

9 Claims, 26 Drawing Sheets

Related U.S. Application Data on Oct. 20, 2014, provisional application No. 62/104,511, filed on Jan. 16, 2015.

(51) Int. Cl.

| | |
|---|---|
| ***F41A 19/12*** | (2006.01) |
| ***F41A 19/14*** | (2006.01) |
| ***F41C 23/04*** | (2006.01) |
| ***F41C 23/16*** | (2006.01) |
| ***F41C 23/20*** | (2006.01) |

(56) References Cited

U.S. PATENT DOCUMENTS

| | | | | |
|---|---|---|---|---|
| 7,975,596 | B2 * | 7/2011 | Darian | F41A 3/38 42/6 |
| 8,176,837 | B1 * | 5/2012 | Jackson | F41A 5/24 89/193 |
| 8,266,998 | B1 * | 9/2012 | Davis | F41A 3/72 42/71.01 |
| 8,407,925 | B2 * | 4/2013 | Fesas | F41A 3/66 42/124 |
| 8,484,877 | B2 * | 7/2013 | Zimmerman | B21C 23/14 42/16 |
| 8,726,557 | B2 * | 5/2014 | Stone | F41C 23/16 42/71.01 |
| 8,789,305 | B1 * | 7/2014 | DiChario | F41A 3/66 42/75.03 |
| 8,850,735 | B2 * | 10/2014 | Kenney | F41A 3/66 42/106 |
| 9,032,860 | B2 * | 5/2015 | Faxon | F41A 15/14 89/193 |
| 9,062,923 | B1 * | 6/2015 | Thorup | F41A 3/64 |
| 9,068,793 | B1 * | 6/2015 | Barrett | F41C 23/16 |
| 9,091,505 | B1 * | 7/2015 | Battaglia | F41C 23/20 |
| 2016/0033218 | A1 * | 2/2016 | Folkestad, II | F41A 3/66 89/194 |

* cited by examiner

FIREARM SYSTEM AND METHODS OF ASSEMBLY AND DISASSEMBLY

RELATED APPLICATION DATA

This application claims priority under 35 U.S.C. §119(e) from U.S. Provisional Patent Application Ser. No. 62/032,122, filed Aug. 1, 2014, U.S. Provisional Patent Application Ser. No. 62/066,045 filed Oct. 20, 2014, and U.S. Provisional Patent Application Ser. No. 62/104,511 filed Jan. 16, 2015, the entirety of the foregoing applications being hereby incorporated by reference.

FIELD

The present disclosure relates to a firearm system and methods of assembling and disassembling a firearm.

BACKGROUND

In the field of firearms, the AK-47 ("AK-47") and AR-15 ("AR-15") rifles are well-known. The AK-47 rifle has a reputation among some as being of relatively simple design, of fairly compact size, relatively inexpensive and straightforward to manufacture, and easy to clean and maintain. The ruggedness and reliability of the AK-47 rifle are well known, and may result from several factors, including a relatively large gas piston within an external piston/cylinder system and generous clearances between moving parts, which together, allow the AK-47 rifle to tolerate significant foreign matter and fouling before failing to cycle after firing a round of ammunition. However, in certain situations, this reliability may come at the cost of accuracy, as the wider tolerances may not allow for the precision and consistency available in other rifle designs. Additionally, other features may impinge on accuracy, such as the rigid attachment of the AK-47's cylinder/piston system to its barrel and the use of separate parts for various features.

The AR-15 rifle is relatively lightweight and accurate, as compared to the AK-47 rifle, and is generally built to stricter tolerances. Also, it includes a barrel claimed to be effectively free-floating, with a bolt carrier and bolt serving in effect as a movable cylinder and stationary piston, as compared to the external cylinder/piston system used by the AK-47 rifle. Instead of directing exhaust gases into a cylinder/piston assembly, the AR-15 rifle includes a self-loading mechanism actuated by the venting of a metered portion of propellant gases (created upon firing a round of ammunition) directly to the bolt carrier. However, such AR-15 rifle gas system may be more prone to introduction of fouling substances into the working mechanism of the rifle, potentially resulting in degraded reliability and/or enhanced cleaning requirements.

Therefore, there exists a need for a relatively lightweight firearm system with improved reliability and accuracy.

SUMMARY

In one aspect, firearm systems are described herein which may provide one or more advantages over prior firearm systems. Further, firearms for firing a cartridge having a projectile are described herein which may provide certain advantages over prior firearms. Additionally, certain apparatus for use in a firearm are described herein.

In one implementation, a firearm system described herein comprises an integrated upper receiver unit, or "upper receiver," having a front trunion, left and right rails, a receiver for a gas cylinder, and a feed ramp. The upper receiver allows for the indexing and supporting of the gas cylinder with respect to the upper receiver and the ability to substantially lock only one end of the gas cylinder (where it engages a gas block discussed below) rather than at both ends of the gas cylinder, to thereby allow the other end of the gas cylinder to generally float freely. Also, the upper receiver includes integrated left and right rails.

Further, in some such implementations, a firearm for firing a cartridge having a projectile is described herein. The firearm can comprise a receiver assembly, a bolt assembly, a barrel, and a gas assembly. The receiver assembly is adapted to receive the cartridge. The bolt assembly includes a firing device operable to fire the cartridge. The barrel is adapted to receive the projectile after the cartridge is fired. The gas assembly includes a gas tube. The receiver assembly includes an upper receiver portion, a lower receiver portion, and an upper receiver cover. The upper receiver portion defines a longitudinal axis and an indexing slot operable to receive the gas tube. Further, the upper receiver portion includes at least one integrated exterior track extending generally parallel to the longitudinal axis and a plurality of interior tracks extending generally parallel to the longitudinal axis. The upper receiver portion and the lower receiver portion are pivotally connected to one another. The upper receiver is adapted to slidably couple with the at least one integrated exterior track, and the bolt assembly is adapted to slidably couple with at least one of the plurality of interior tracks.

Alternatively, in some implementations, an apparatus for use in a firearm is described herein. The firearm is operable to fire a cartridge having a projectile and has a firing device operable to fire the cartridge and a barrel adapted to receive the projectile after the cartridge is fired. The apparatus can comprise a gas assembly and a receiver assembly. The gas assembly includes a gas tube. The receiver assembly includes an upper receiver portion, a lower receiver portion, and an upper receiver cover. The upper receiver portion defines a longitudinal axis and an indexing slot operable to receive the gas tube. Further, the upper receiver portion includes at least one integrated exterior track extending generally parallel to the longitudinal axis and a plurality of interior tracks extending generally parallel to the longitudinal axis. The upper receiver portion and the lower receiver portion are pivotally connected to one another. The upper receiver is adapted to slidably couple with the at least one integrated exterior track.

In another implementation, a firearm system described herein comprises a gas piston system which includes a gas piston, a pin (which could include a roll pin), a gas piston plunger, a gas piston spring washer, a gas piston spring, a gas block, a gas block plunger, a gas block retaining screw, a gas block pin (which could include a roll pin), a gas tube throat, a gas tube, and a plug valve. The gas block is mounted to the firearm's barrel, and an aperture is provided in the barrel which is in fluid communication with the gas block to vent expanding propellant gas (created upon firing a round of ammunition) into the gas block. At the other end of the gas block, directly above the barrel, the gas cylinder is mounted through the gas block from the anterior side, and the posterior end of the gas cylinder is seated into the upper receiver. The gas cylinder is substantially free-float attached at the gas block to reduce transfer of pressures from moving parts, or from the potential expansion of components as the firearm heats up during use. A gas valve may be mounted in the cylinder just forward of the gas block. The gas valve may be indexable to allow relatively greater or lesser amounts of propellant gasses generated from firing a round of ammunition to enter the cylinder, according to ammunition specifics, environmental conditions, etc. Alternately, the gas valve can be turned off to substantially prevent propellant gasses from being transferred into the gas cylinder, thereby converting the firearm from a semi-automatic rifle into a single-fire, bolt action rifle. The recoil spring may be configured to reside in the gas cylinder, and the gas piston to act as a recoil spring guide. The recoil spring is secured on the gas piston by means of a pin, such as a roll pin, which also indexes the piston.

In some such implementations, a firearm for firing a cartridge having a projectile is described herein. The firearm can comprise a bolt assembly, a barrel, a receiver assembly, a gas assembly, and a charging handle. The bolt assembly includes a firing device operable to fire the cartridge. The barrel is adapted to receive the bullet after the cartridge is fired. The barrel has a projectile entry end, a projectile exit end, and an outer periphery. The barrel defines a bore extending from the entry end to the exit end and a gas channel in communication with the bore and the outer periphery. The receiver assembly is adapted to receive the cartridge and to engage the barrel. The gas assembly includes a gas tube, a plunger, a plunger spring. a gas block, a valve, and a gas throat. The gas tube defines a first end and a second end, the first end being adapted to engage the receiver assembly. The gas tube also defines an outer periphery thereof. The plunger is carried substantially within the gas tube, and defines a periphery and a notch in the periphery. The plunger spring is operable to engage the plunger within the gas tube. The gas block defines a first cylindrical receiver, a second cylindrical receiver in communication with the first cylindrical receiver, and a gas port in communication with the first cylindrical receiver and the second cylindrical receiver. The first cylindrical receiver is adapted to surround the outer periphery of the barrel, and the second cylindrical receiver is adapted to surround the outer periphery of the gas tube. The gas throat has a first portion adapted to engage the second end of the gas tube and a second portion adapted to receive the valve. The gas assembly is operable to direct a portion of gas generated when the firearm is fired through the gas channel into the gas port and into the gas tube. The gas directed through the gas port serves to actuate the plunger. The notch in the plunger is adapted to receive the charging handle. The plunger operates separately from the bolt assembly upon the charging handle not being engaged with the plunger.

In another implementation, a firearm system described herein comprises a charging handle system which includes a charging handle, a charging handle actuator, a charging handle pin (such as a roll pin), and a charging handle spring. The charging handle system can be ambidextrous, allowing insertion of the charging handle from either side of the upper receiver, to lock the gas piston to the bolt carrier. The charging handle can be configured as a locking pin which, when keyed or otherwise fixed into place, may fasten the gas piston to the bolt carrier without a threaded connection, weld, or other fixation technique. The charging handle contains a recessed, spring-loaded plunger which actuates a retaining catch assembly and can be removable by depressing the recessed plunger from the exterior using a tool or other suitable object. The retaining catch assembly can include two adjacent cam lobes of differing heights, a first cam lobe and a second cam lobe, one positioned on either side of a pivot point, such as a roll pin, in the retaining catch assembly. The plunger can have two recesses, a first recess and a second recess, such that one or the other of the first and second cam lobes can be engaged depending on whether the plunger is in a depressed or undepressed position. When the plunger is in a normal position, the first cam lobe is mated to a first recess in the plunger, and the second cam lobe is depressed, fixing the retaining catch into position to retain the charging handle in the bolt carrier. When the plunger is depressed, the first cam lobe is unseated from the first recess and the second cam lobe is mated to the second recess. The unseating of the first cam lobe and mating of the second cam lobe can result in a pivot-type movement that moves the retaining catch into a depressed position, permitting removal of the charging handle from the bolt carrier.

In some such implementations, a firearm for firing a cartridge having a projectile is described herein. The firearm comprises a bolt assembly, a gas assembly, and a charging handle. The gas assembly includes a plunger, a plunger spring surrounding the plunger, and a plunger spring pin to retain the plunger spring in position surrounding the plunger. The plunger has a first end and a second end and defines a notch in the second end. The charging handle includes a spring-biased plunger and a retaining catch assembly. The charging handle is adapted to releasably engage the notch in the second end of the plunger of the gas assembly and to releasably engage with the bolt assembly. Firing the cartridge causes the plunger, the bolt assembly, and the charging handle to actuate in a first direction as a unitary component. The plunger spring causes the plunger, the bolt assembly, and the charging handle to actuate in a second direction as a unitary component after completing actuation in the first direction.

In a further implementation, a firearm system described herein comprises a lower receiver of a shell design that is hinged at the anterior end thereof to an upper receiver, and, in combination with the rear trunion (discussed below) allows the present firearm system to be readily opened (with the posterior end of each the upper receiver and lower receiver being separated from one another), for access to the interior parts, such as for cleaning and maintenance, and closed (with the posterior end of each the upper receiver and lower receiver being in contact with one another). In the closed position, the lower receiver is effectively mated to the upper receiver along its length and includes a castling configuration, i.e., recesses which accommodate a unique series of protrusions in the upper receiver.

In still another implementation, a firearm system described herein comprises a rear trunion that houses a retaining mechanism, or catch, which simultaneously secures the upper receiver and lower receiver together and also the pistol grip attachment and safety plunger in place. The catch includes a beveled, spring-loaded, sliding latch, which opens readily when manipulated, for access to interior parts of the firearm system, such as for cleaning and maintenance, and which selectively readily locks the upper and lower receivers securely together when the firearm is to be operated. The bevel is configured to allow the firearm system, or, firearm, to be closed without manipulating the catch and to "click" audibly to signal that the firearm is securely "closed", or assembled, in a manner substantially preventing unintentional access to interior parts of the firearm system without actuation of the catch.

In yet another implementation, a firearm system described herein comprises a spring-loaded plunger-style ejector integrated into the bolt located in the bolt face, which ejects the case as soon as the case mouth clears the chamber on extraction.

In another implementation, an ambidextrous safety which can be operated from either a left or right side of the firearm system to select between a firing position and a safe position.

In a yet further implementation, a firearm system described herein can comprise a magazine latch including an enlarged flat engagement surface disposed at an angle relative to a body portion of the magazine latch. The engagement surface, in some cases, is adapted to provide a leading edge positioned such that insertion of a magazine into a magazine slot of the firearm system will result in at least one of the leading edge and the enlarged flat engagement surface to engage the magazine and to retain the magazine in the magazine slot. In certain instances, a magazine latch described herein can be configured or adapted to be removable and/or replaceable. For example, a magazine latch can comprise or include a locking pin and clip assembly to permit removal and/or replacement of the magazine latch. Further, in some implementations, a magazine latch assembly can be configured such that a magazine latch is spring-biased against a magazine upon insertion.

In some such implementations, a firearm for firing a cartridge having a projectile is described herein. The firearm comprises a receiver portion adapted to receive the cartridge, a firing device operable to fire the cartridge, a barrel adapted to receive the projectile after the cartridge is fired, and a magazine adapted to carry the cartridge, the magazine including a locking lug. The firearm further comprises a magazine latch assembly. The magazine latch assembly defines at least one through-hole and includes an elongated magazine latch surface, a flat engagement surface opposite the through-hole, the flat engagement surface defining a leading edge, and the flat engagement surface being adapted to engage the locking lug, a spring-like member, brackets disposed on opposing sides of the magazine latch surface, and a latch locking pin adapted to pass through the through-hole to provide a pivot point for the magazine latch. The spring-like member is adapted to bias the magazine latch towards a locked position such that insertion of the magazine into the receiver portion causes pivoting of the magazine latch about the latch locking pin.

In certain instances of such implementations, a magazine latch assembly for use on a firearm is described herein. The firearm is operable to fire a cartridge having a projectile and has a firing device operable to fire the cartridge and a barrel adapted to receive the projectile after the cartridge is fired. The magazine latch comprises a magazine latch defining at least one through-hole and includes: an elongated magazine latch surface; a flat engagement surface opposite the through-hole, the flat engagement surface defining a leading edge and the flat engagement surface being adapted to engage the locking lug; a spring-like member; brackets disposed on opposing sides of the magazine latch surface; and a latch locking pin adapted to pass through the through-hole to provide a pivot point for the magazine latch The spring-like member is adapted to bias the magazine latch towards a locked position such that insertion of the magazine into the receiver portion causes pivoting of the magazine latch about the latch locking pin.

Another implementation may include a method of assembly and/or operation of a portion of a firearm, wherein a gas cylinder is inserted into a receiver and then rotated until it locks into the receiver by means of a plurality of lugs (which may include three lugs) and then indexing the gas cylinder in a receiver trunion. The method may further include inserting a gas piston and recoil spring into the gas cylinder, and inserting a gas valve into the gas cylinder and then selectively indexing the gas valve to allow for relatively greater or lesser amounts of propellant gasses to enter the cylinder.

These and other implementations are described in greater detail in the detailed description which follows.

BRIEF DESCRIPTION OF THE FIGURES

Figure 1:
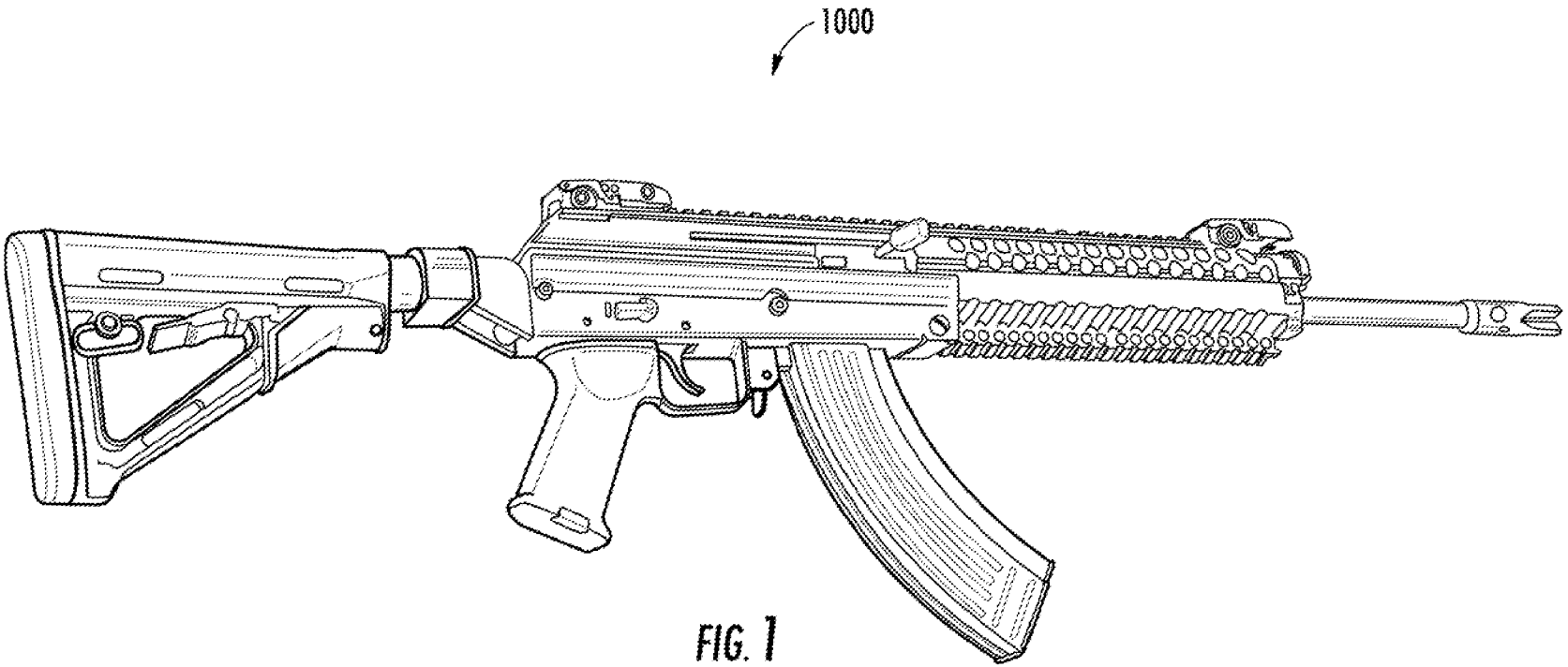
Figure 2:
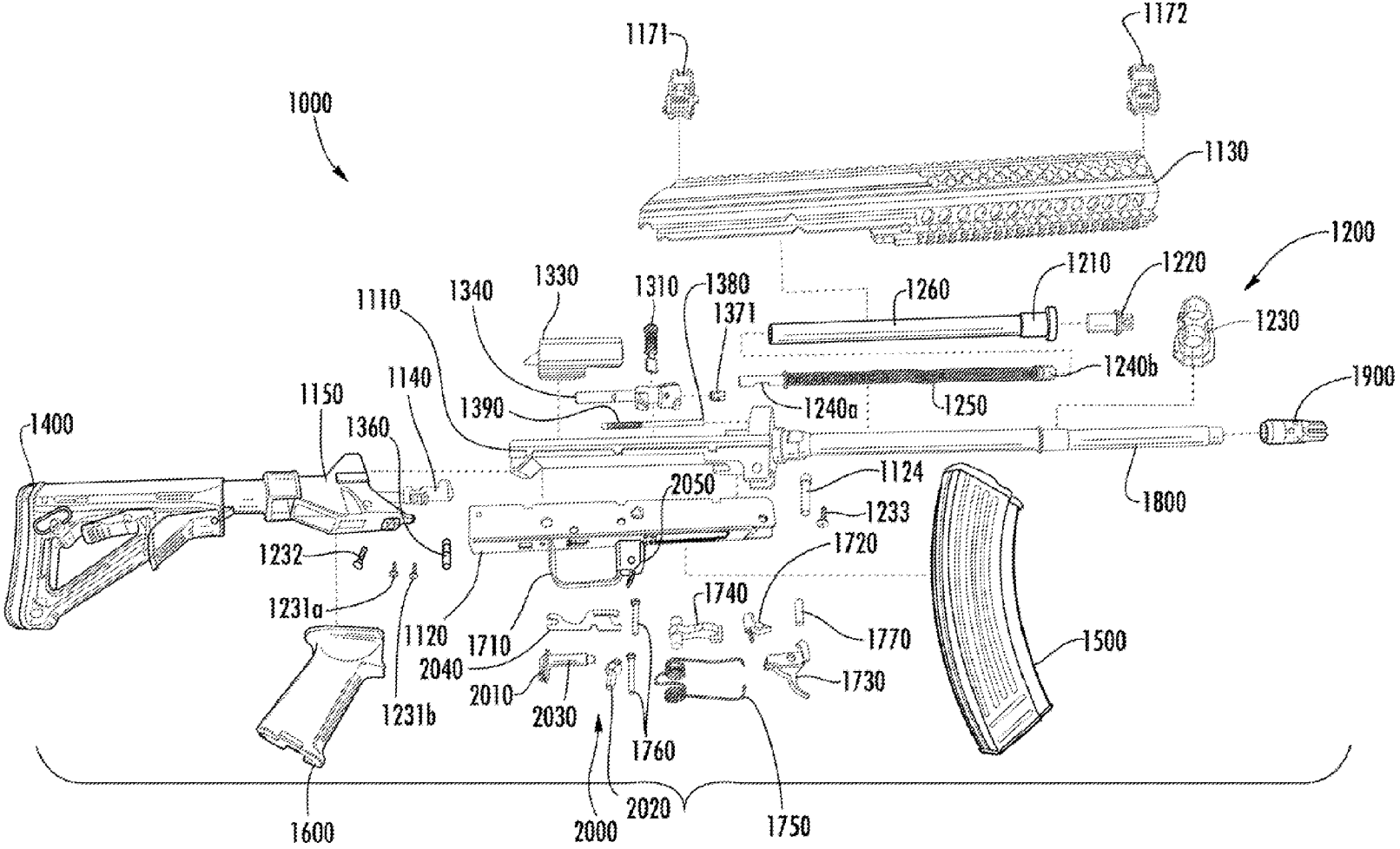
Figure 3A:
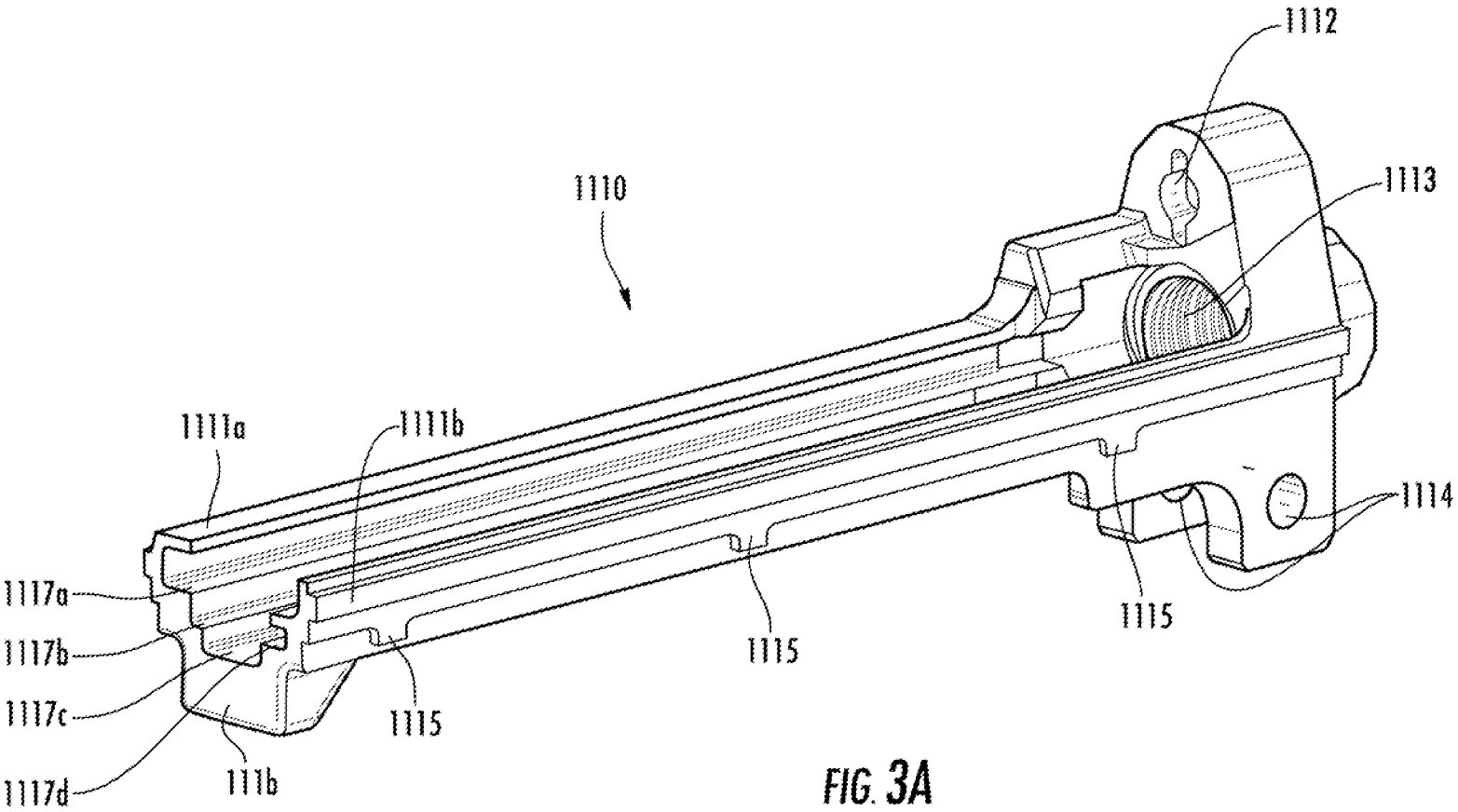
Figure 3B:
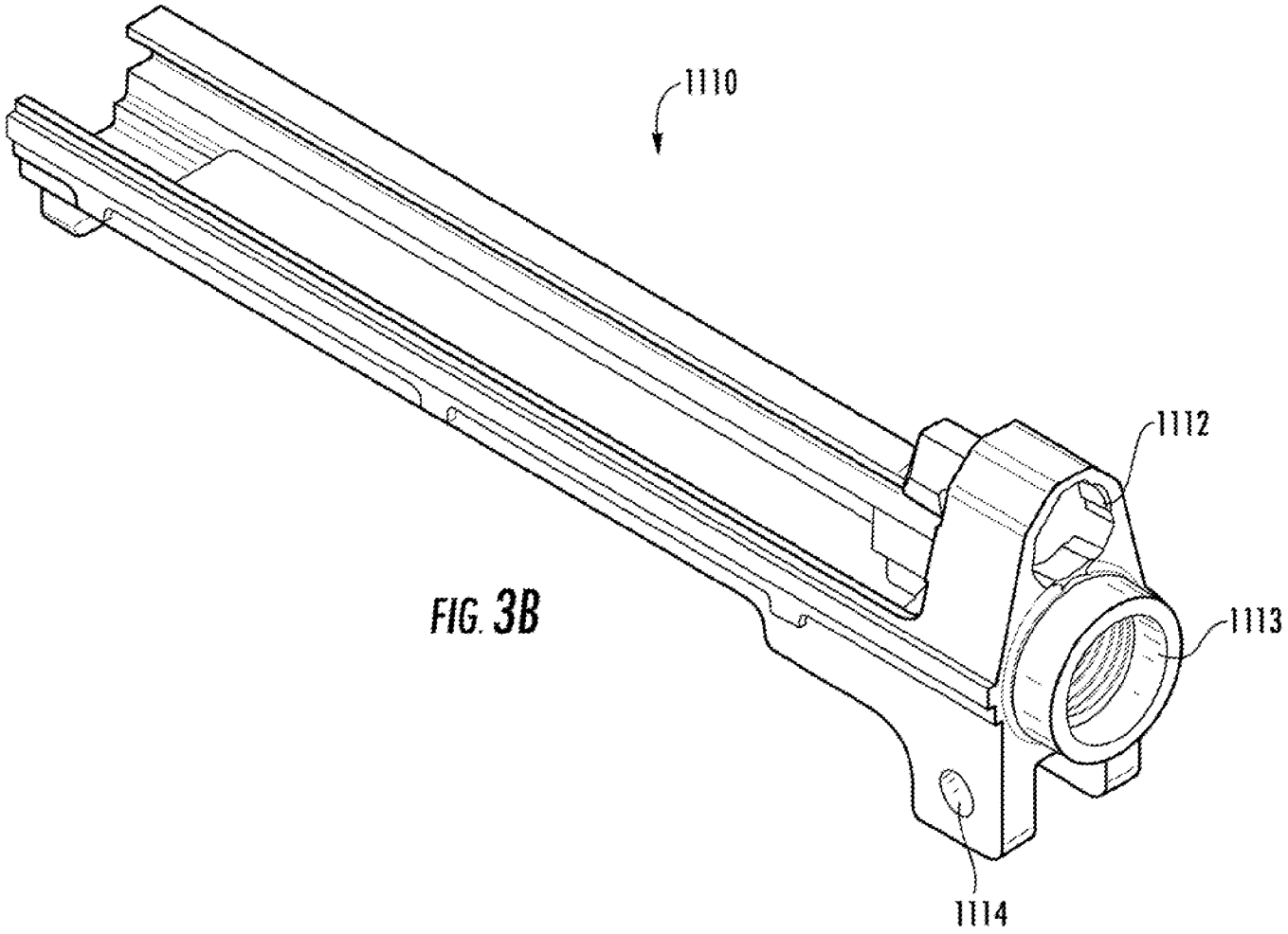
Figure 3C:
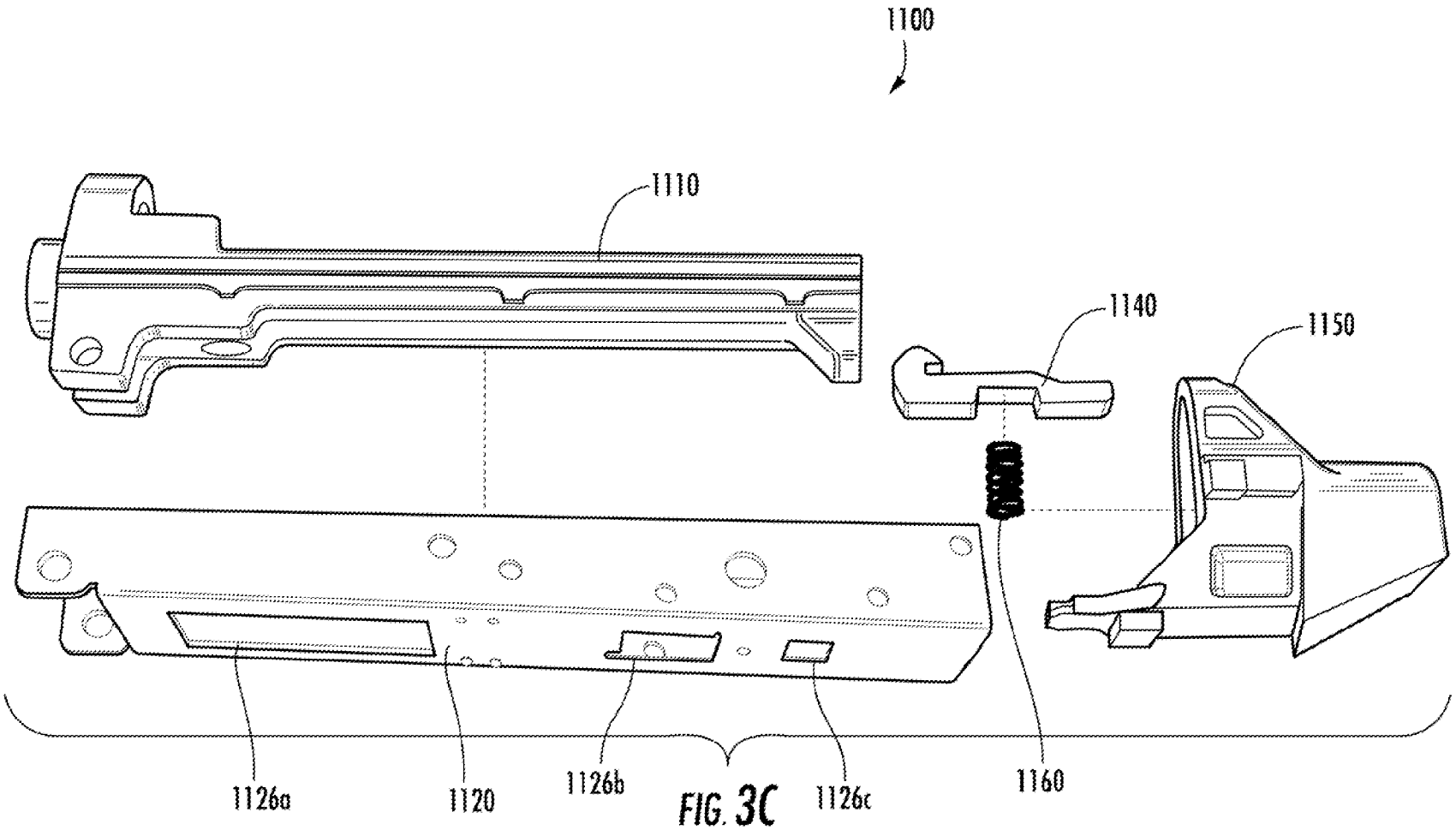
Figure 3D:
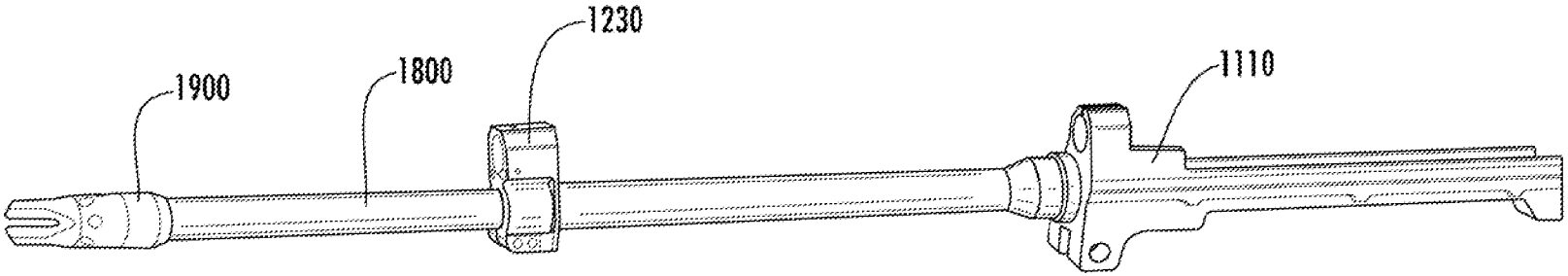
Figure 4A:
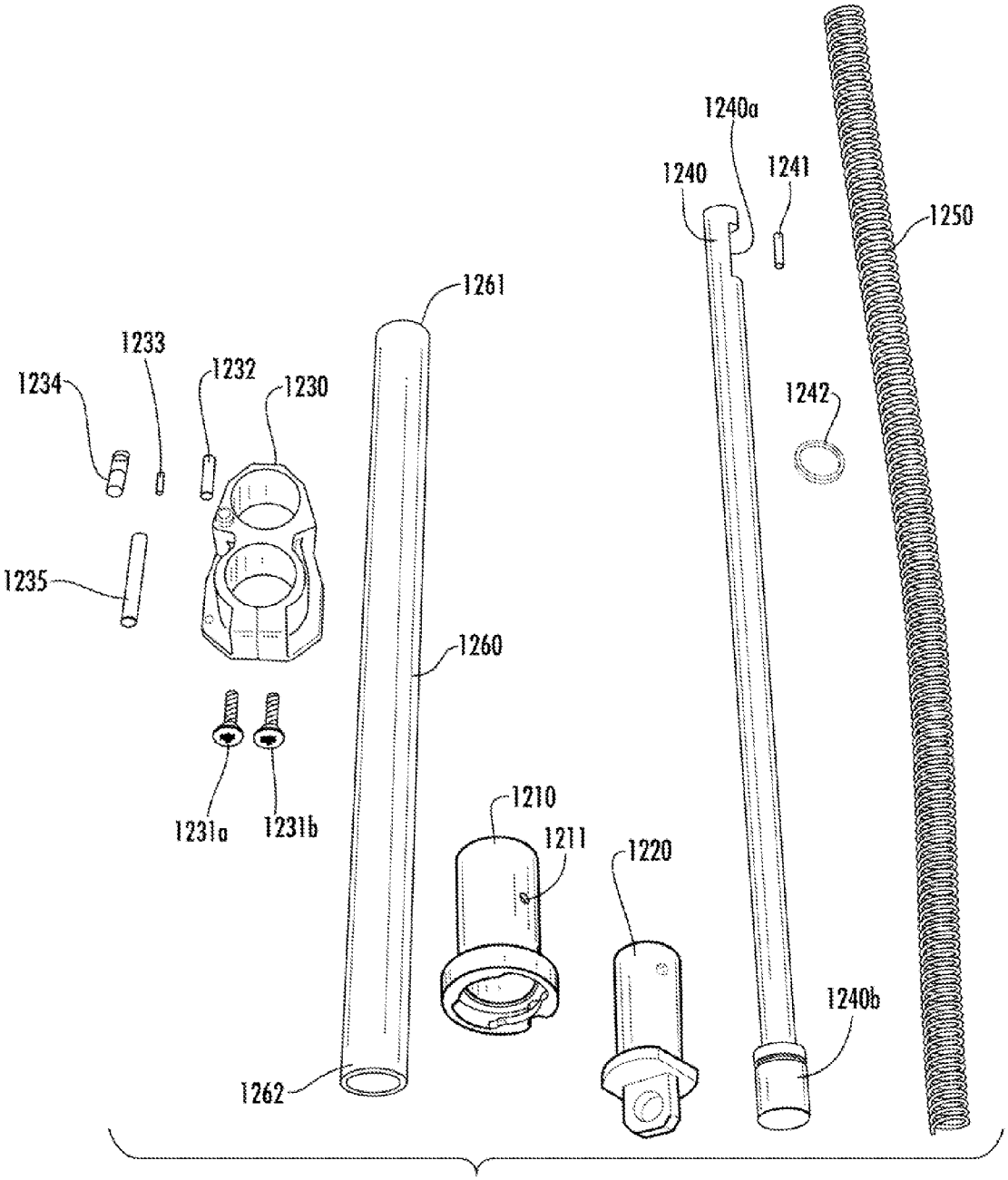
Figure 4B:
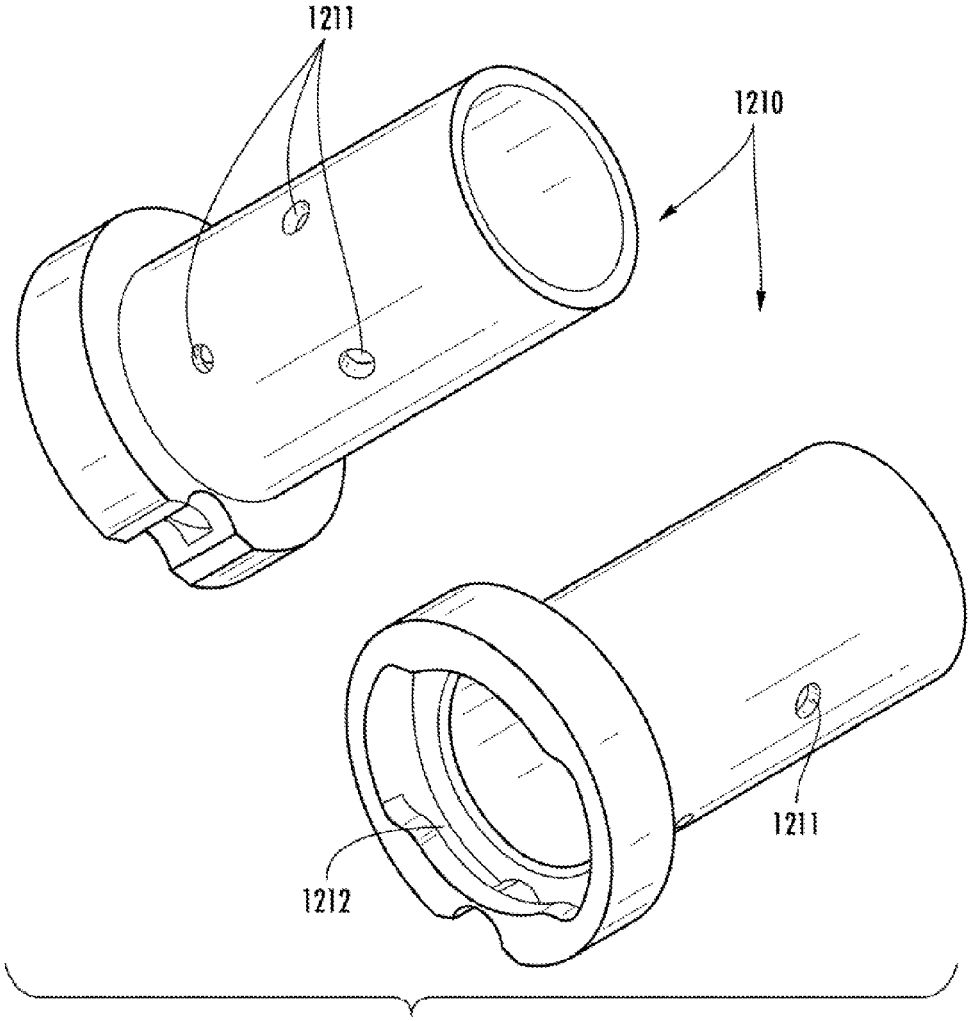
Figure 4C:
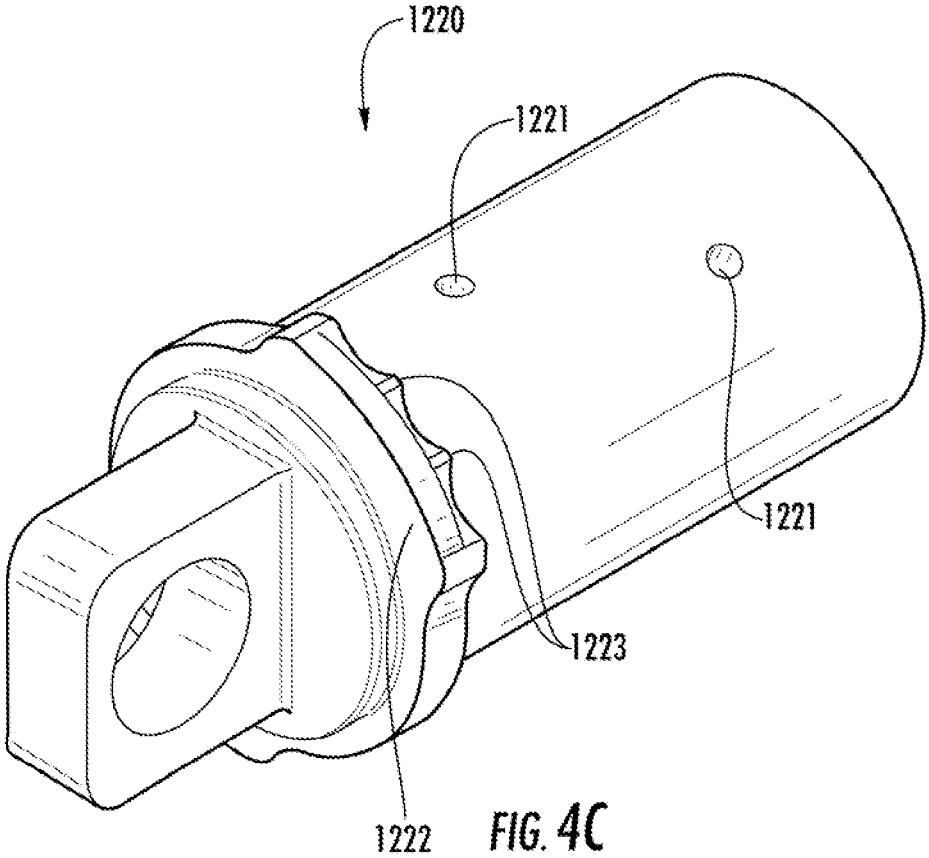
Figure 5B:
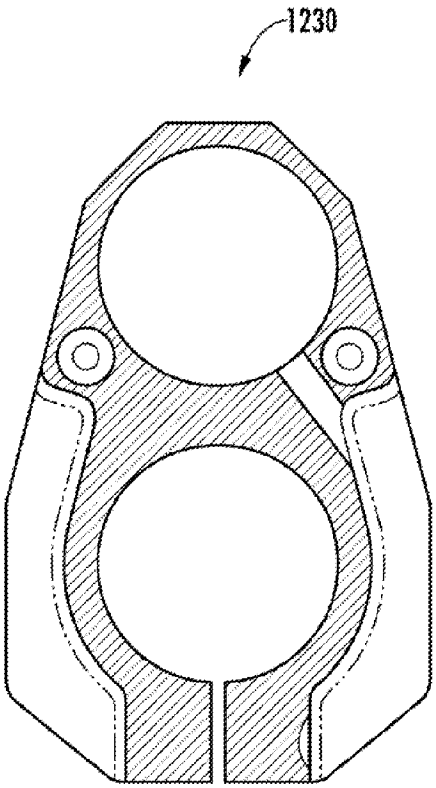
Figure 5A:
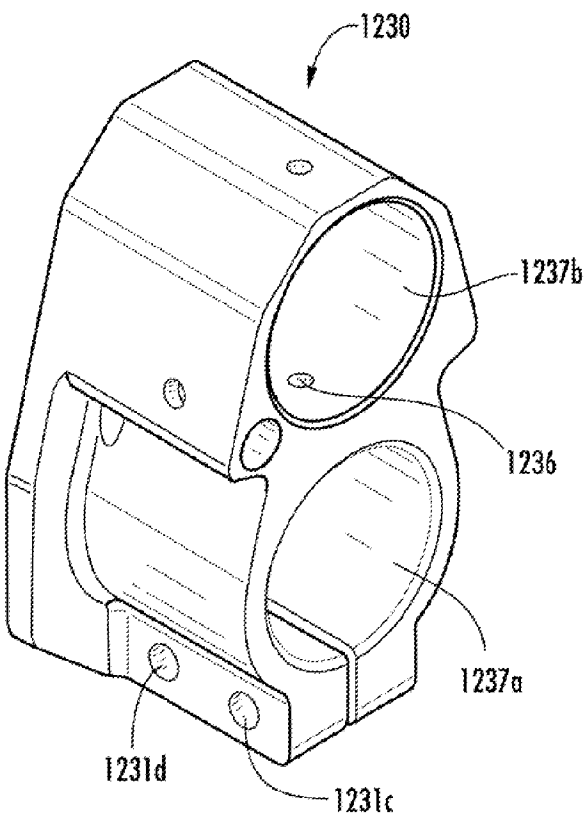
Figure 6A:
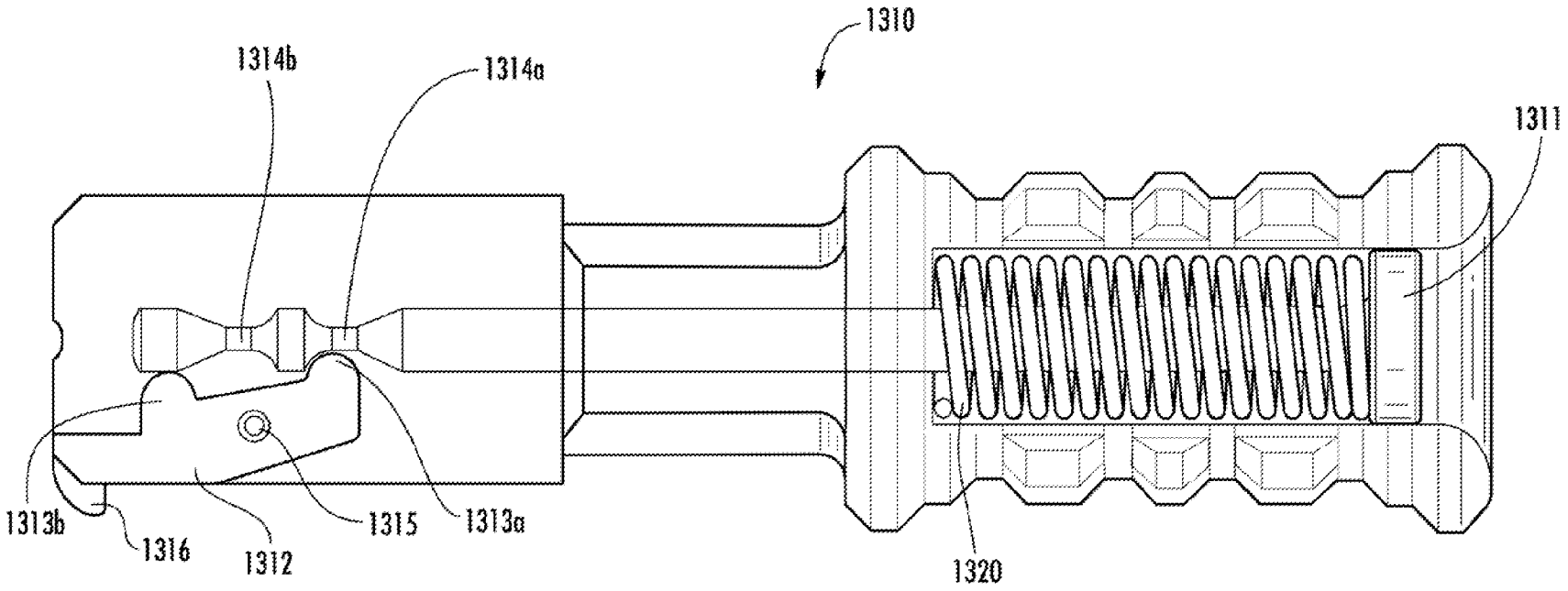
Figure 6B:
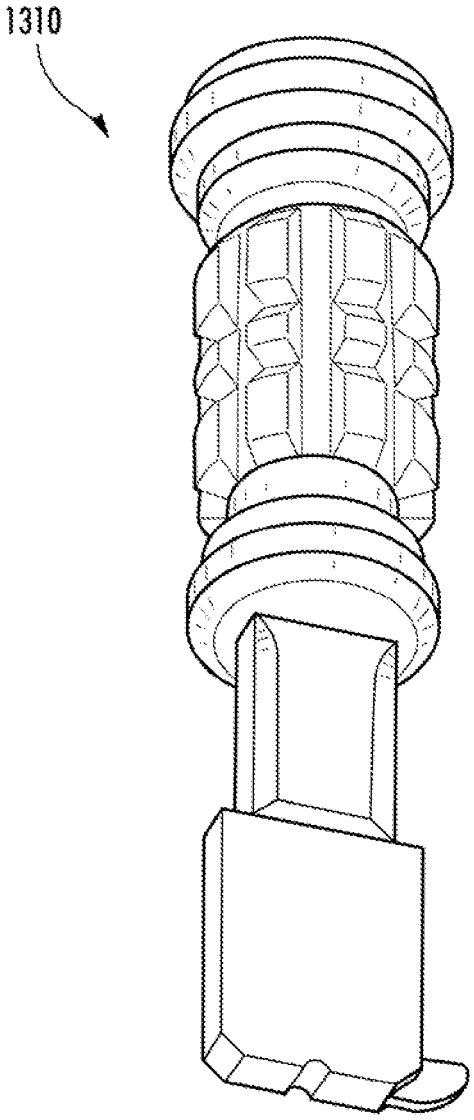
Figure 7A:
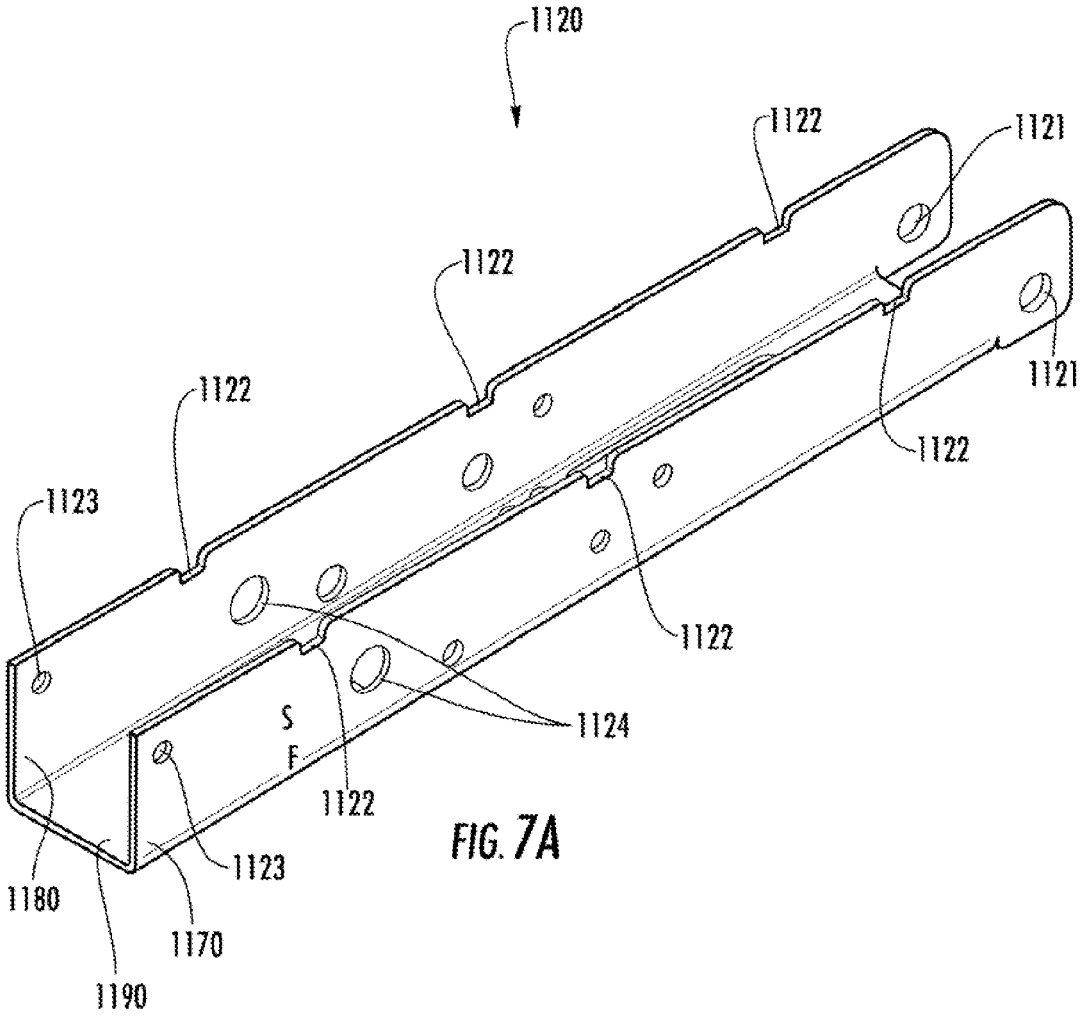
Figure 7B:
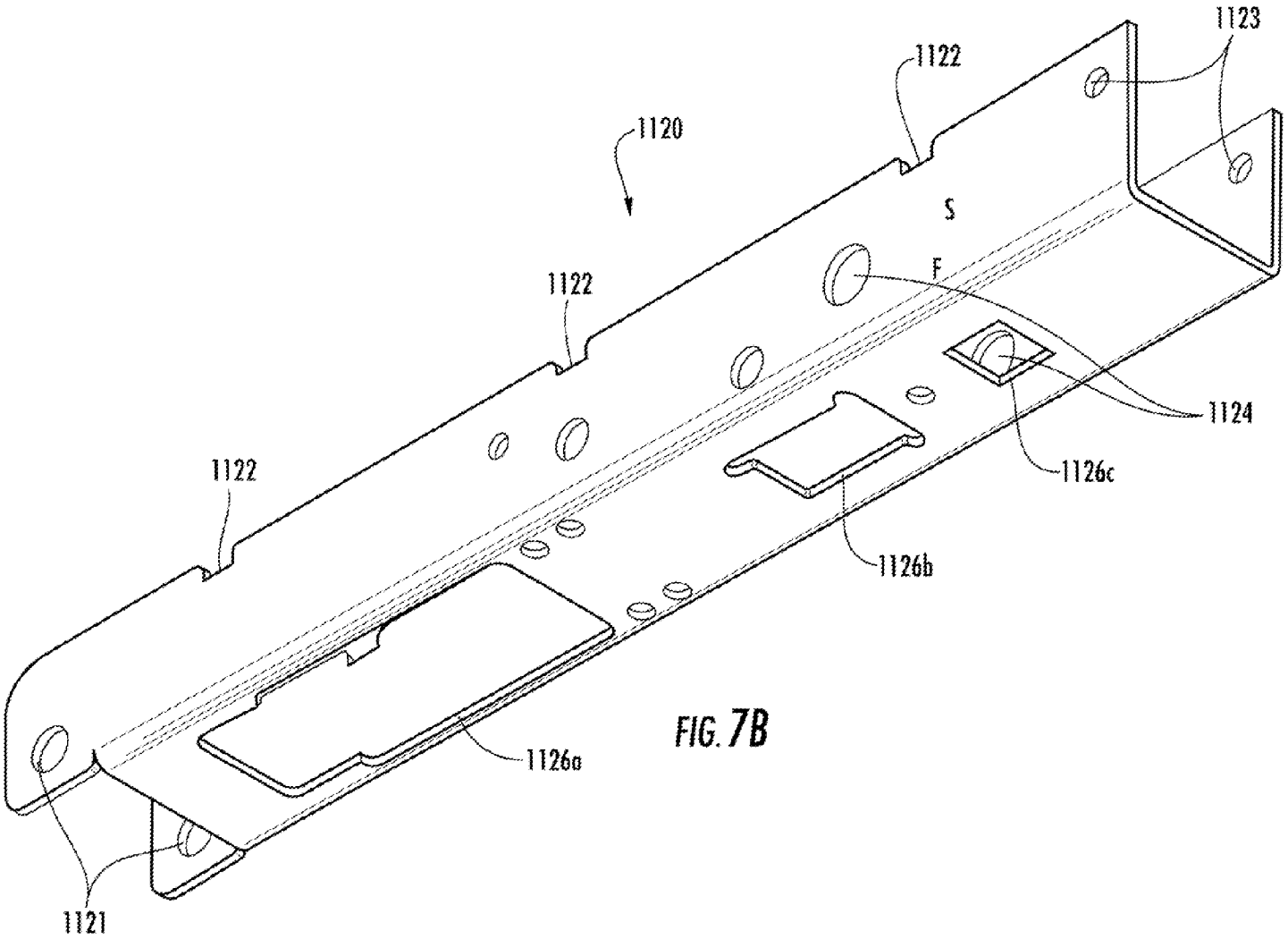
Figure 8A:
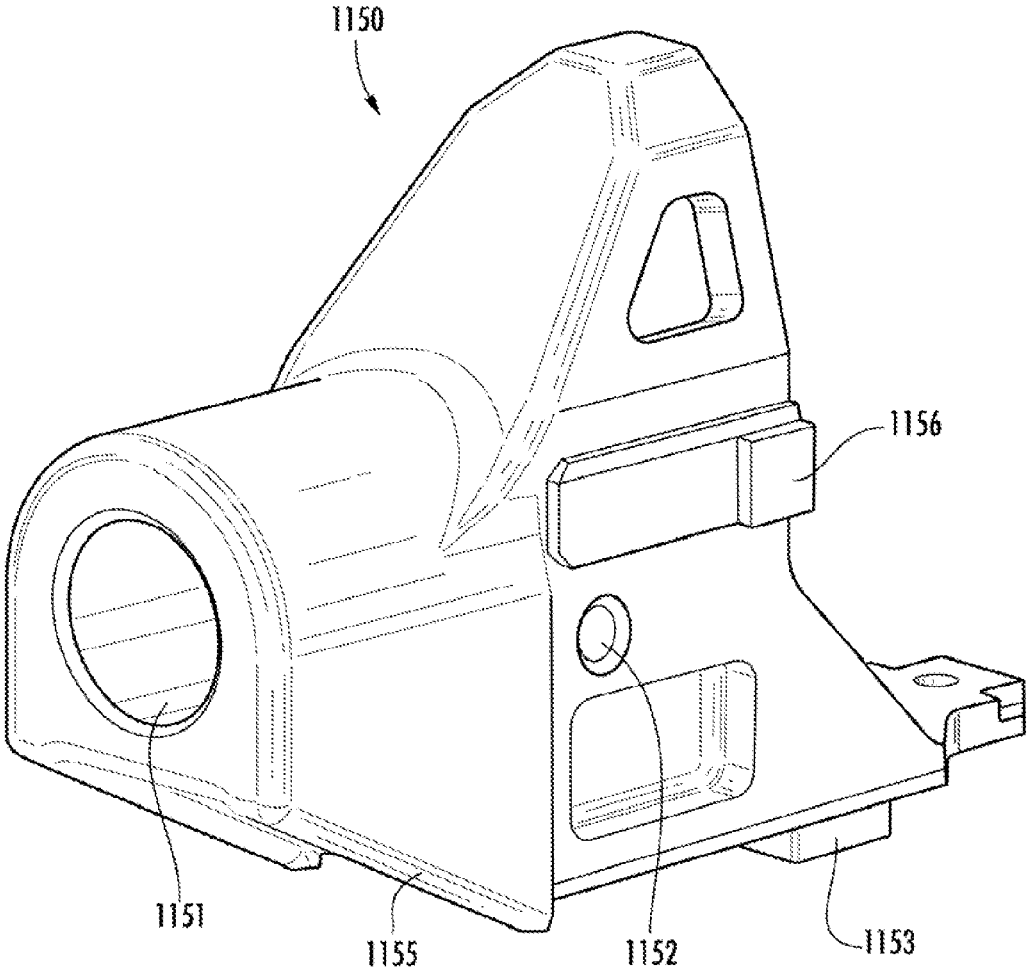
Figure 8B:
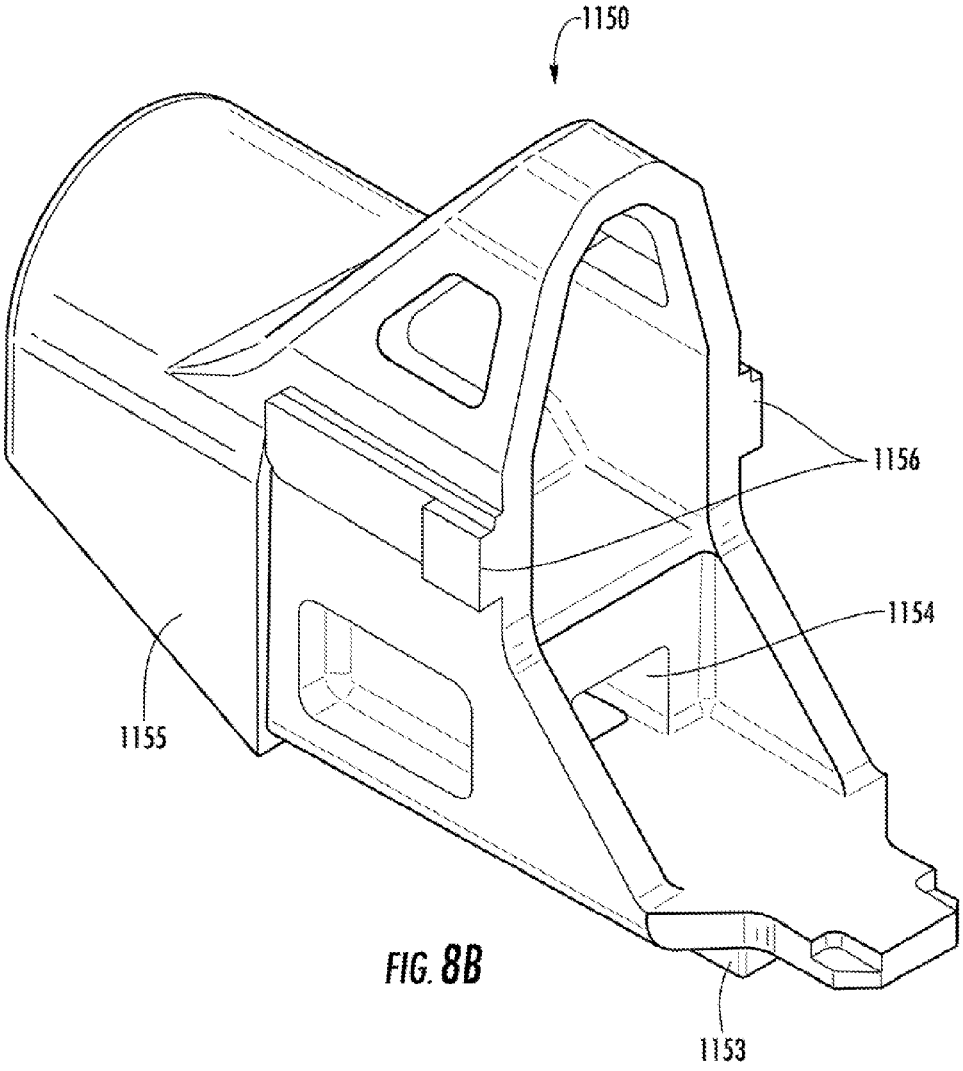
Figure 9A:
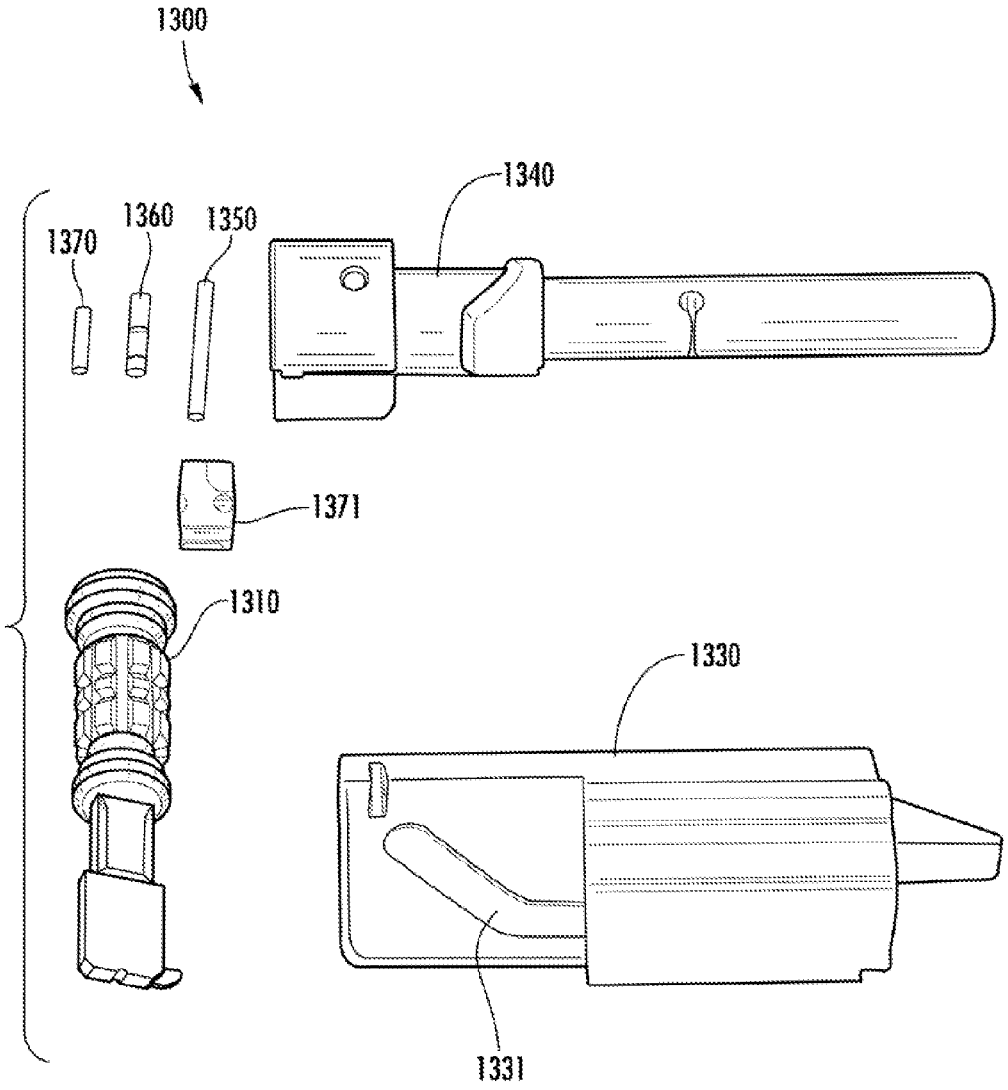
Figure 9B:
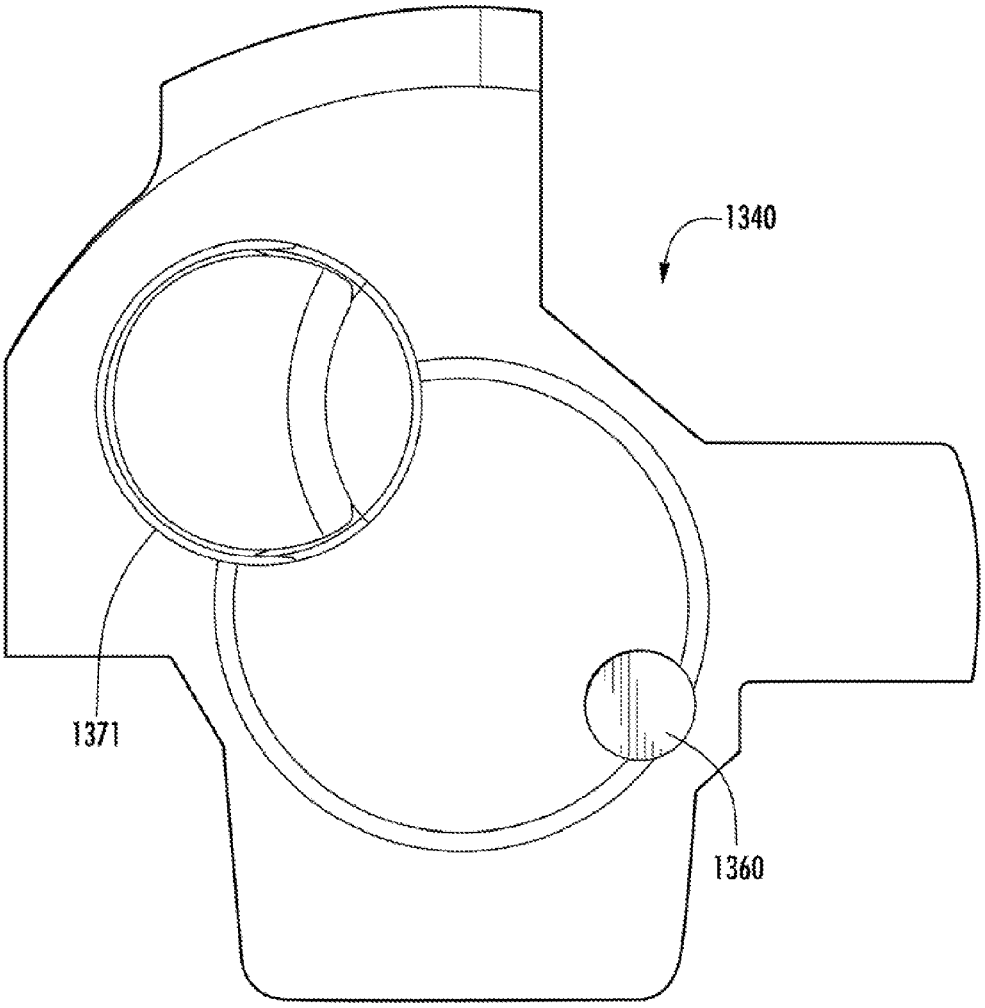
Figure 9C:
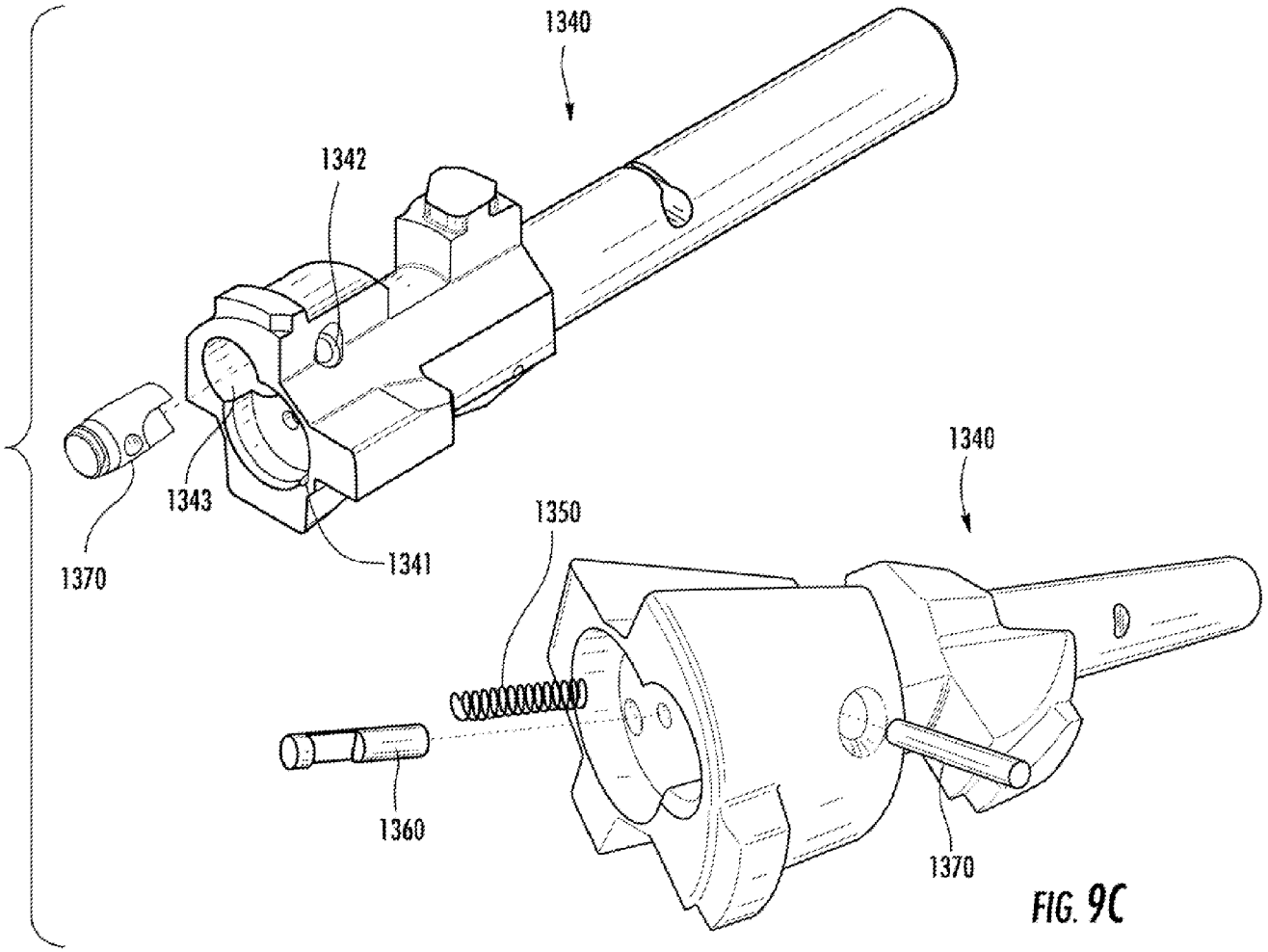
Figure 10A:
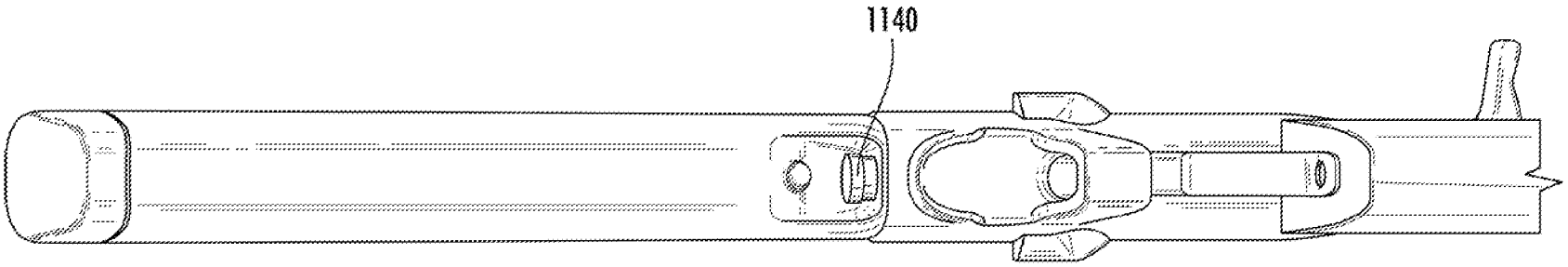
Figure 10B:
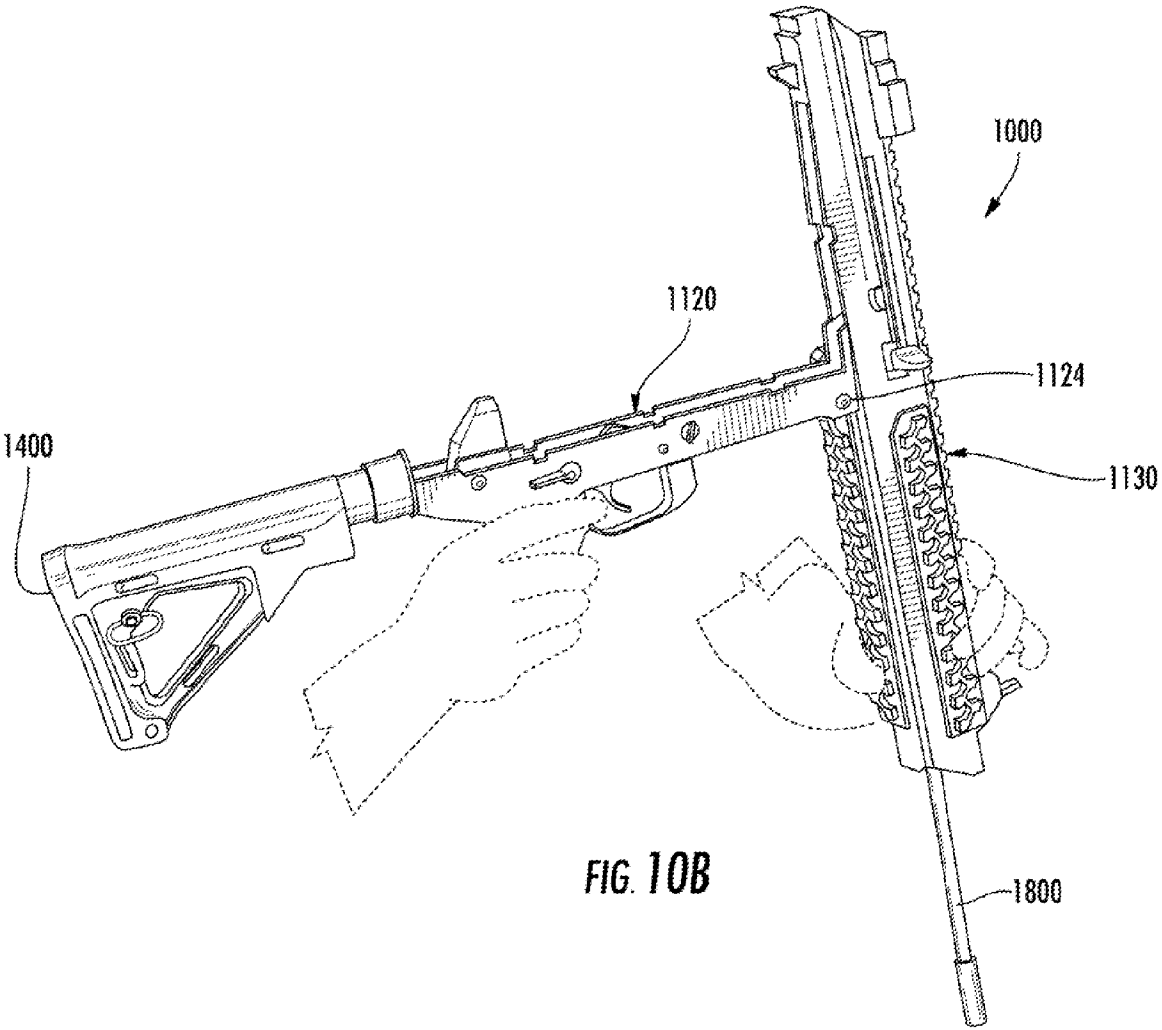

Having thus described exemplary aspects of the disclosure in general terms, reference will now be made to the accompanying drawings, which are not necessarily drawn to scale, and wherein:

FIG. 1 is a perspective view of one implementation of a firearm system described herein;

FIG. 2 is an exploded view of one implementation of a firearm system described herein;

FIGS. 3A and 3B are perspective views of one implementation of an upper receiver described herein;

FIG. 3C is an exploded view of one implementation of an upper receiver, lower receiver, rear trunion, and latch described herein;

FIG. 3D is a perspective view of one implementation of a barrel and upper receiver of a firearm system described herein;

FIG. 4A is an exploded view of one implementation of a gas system of a firearm system described herein;

FIG. 4B is a perspective view of one implementation of a gas tube throat of a firearm system described herein;

FIG. 4C is a perspective view of one implementation of a valve of a firearm system described herein;

FIGS. 5A and 5B are perspective views of one implementation of a gas block of a firearm system described herein;

FIG. 6A is a schematic elevation view of one implementation of a charging handle of a firearm system described herein;

FIG. 6B is a perspective view of one implementation of a charging handle of a firearm system described herein;

FIGS. 7A and 7B are perspective views of one implementation of a lower receiver of a firearm system described herein;

FIGS. 8A and 8B are perspective views of one implementation of a rear trunion of a firearm system described herein;

FIG. 9A is an exploded view of one implementation of an ejector system of a firearm system described herein and one implementation of a charging handle usable with the ejector system;

FIG. 9B is a perspective view of one implementation of a bolt of a firearm system described herein;

FIG. 9C is a partial sectional view of one implementation of a bolt assembly of a firearm system described herein;

FIG. 10A is a perspective view of one implementation of a locking device of a firearm system described herein perspective view of the lock release button; and FIG. 10B is a perspective view of the implementation of FIG. 10A in which the firearm system is "open" after engaging the lock release button.

Figure 11A:
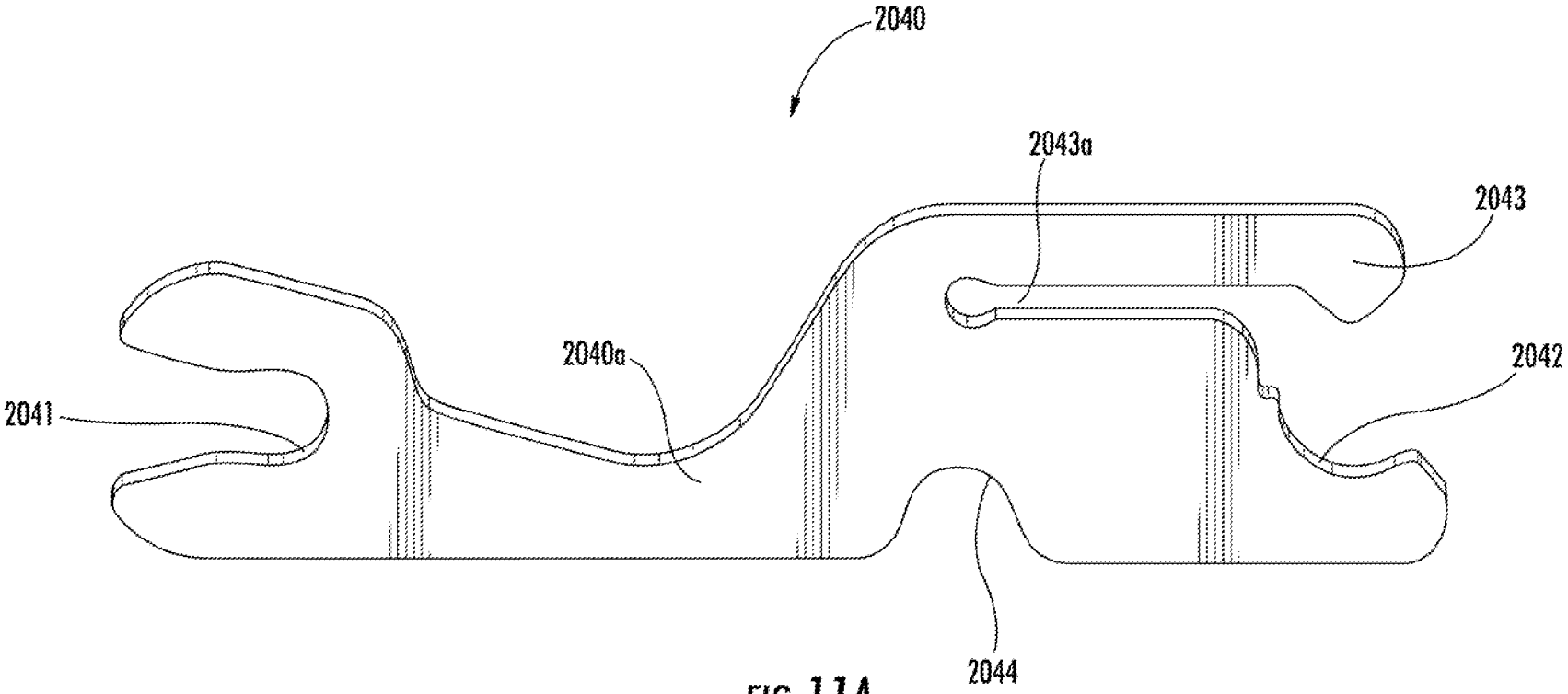

FIG. 11A is a perspective view of one implementation of a locking plate of a firearm system described herein.

Figure 11B:
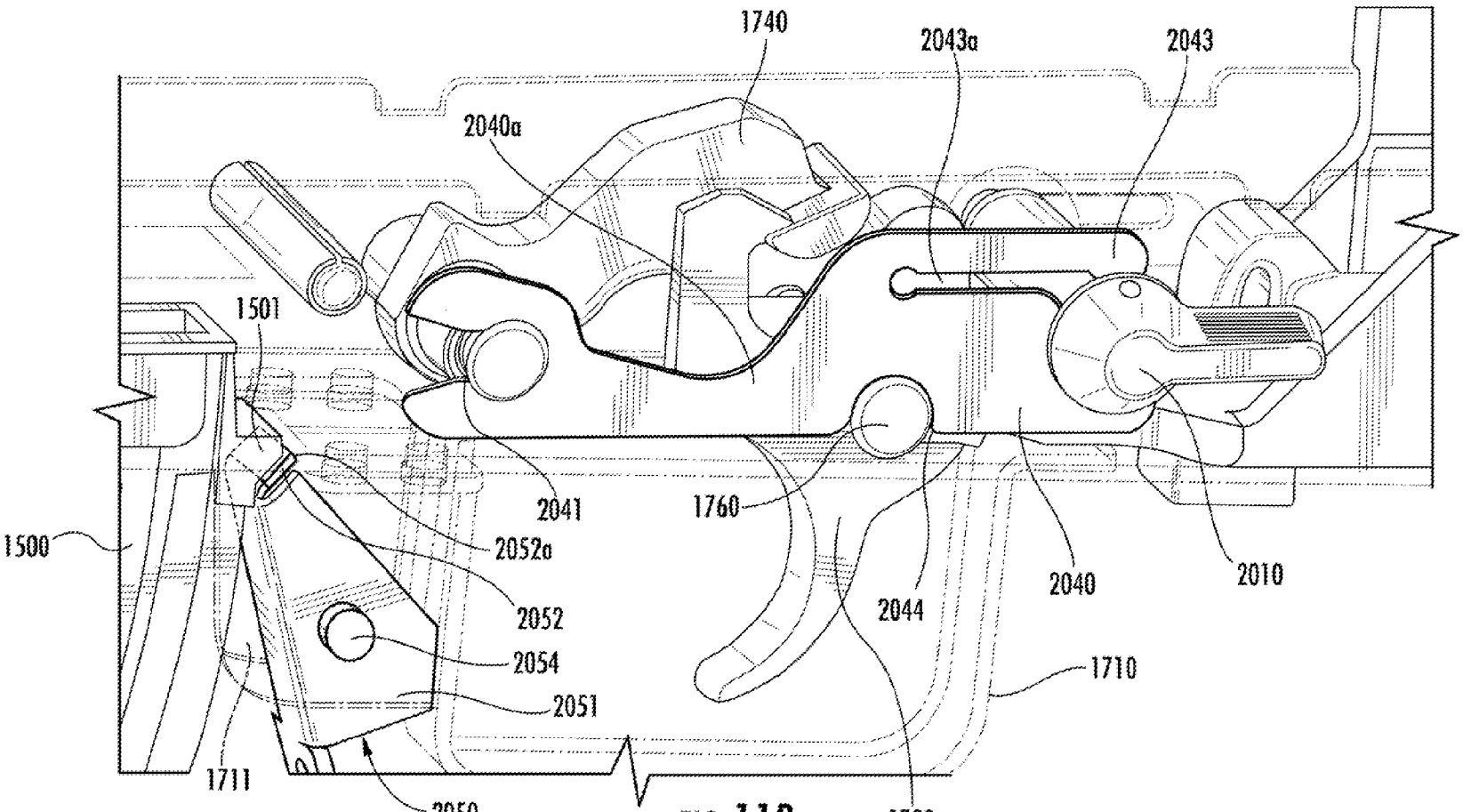

FIG. 11B is a perspective view of a trigger assembly including the implementation of a locking plate according to FIG. 11A.

Figure 11C:
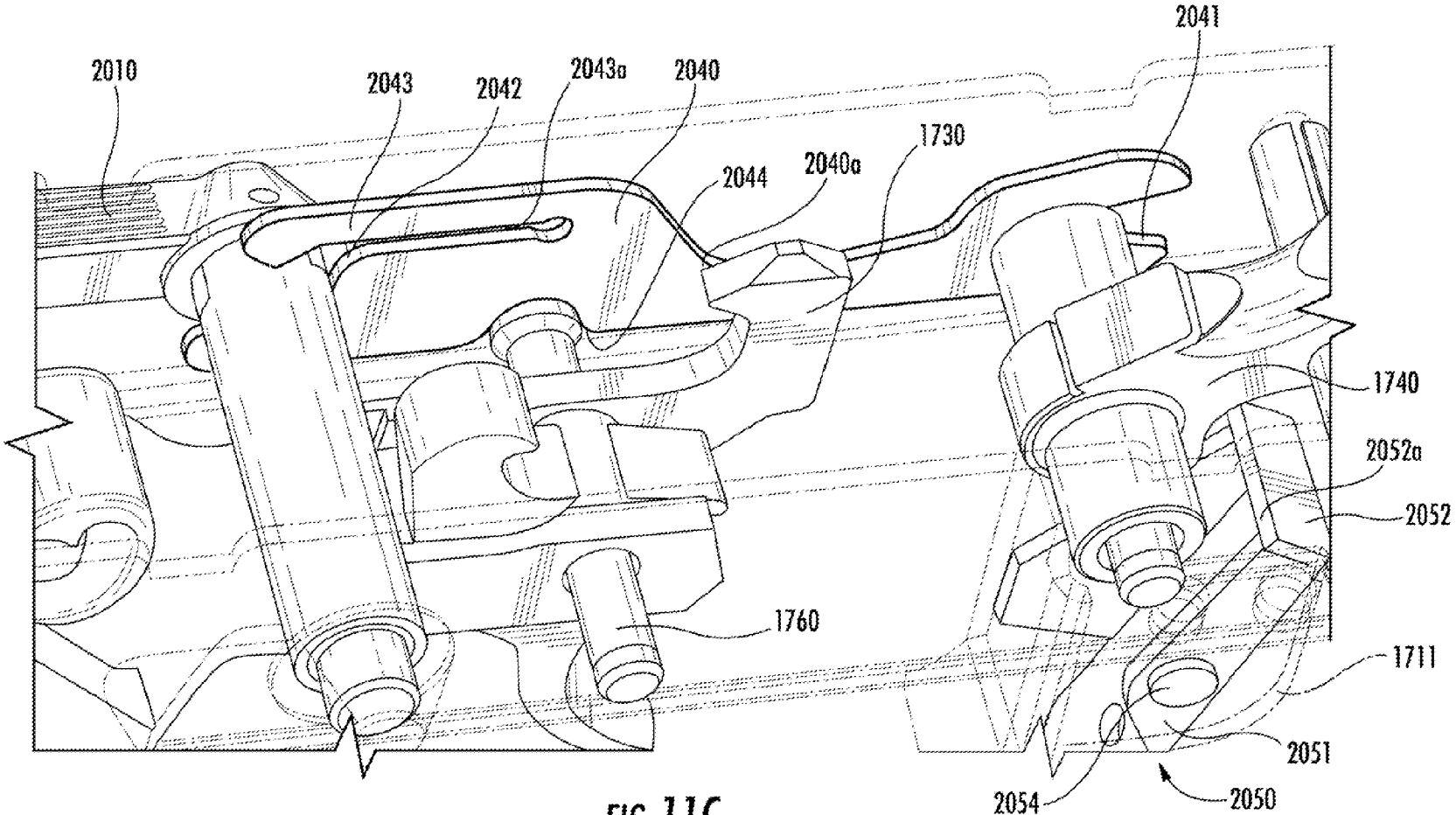

FIG. 11C is a perspective view of the implementation of a trigger assembly according to FIG. 11B.

Figure 12A:
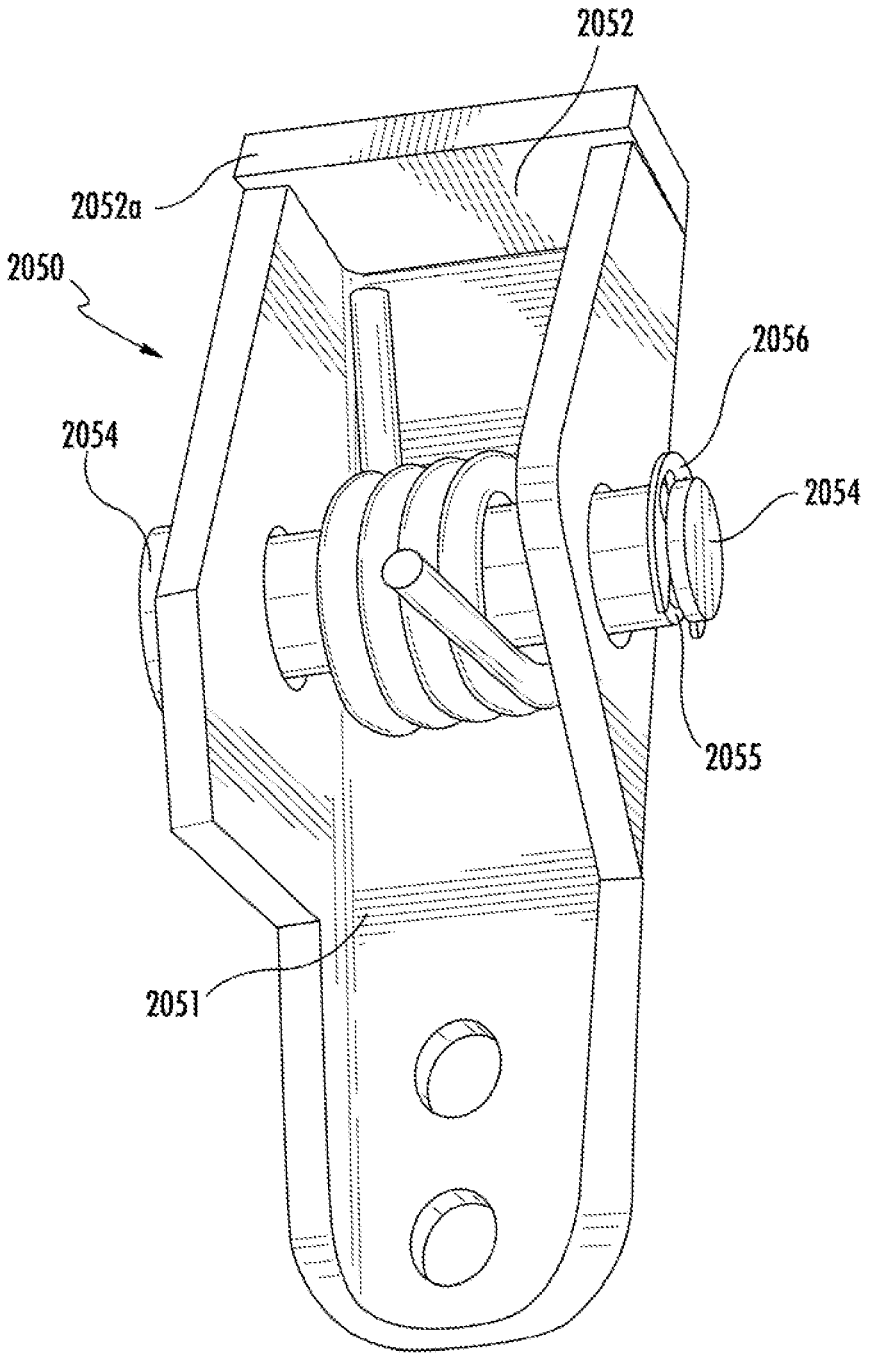

FIG. 12A is a perspective view of one implementation of a magazine latch assembly described herein.

Figure 12B:
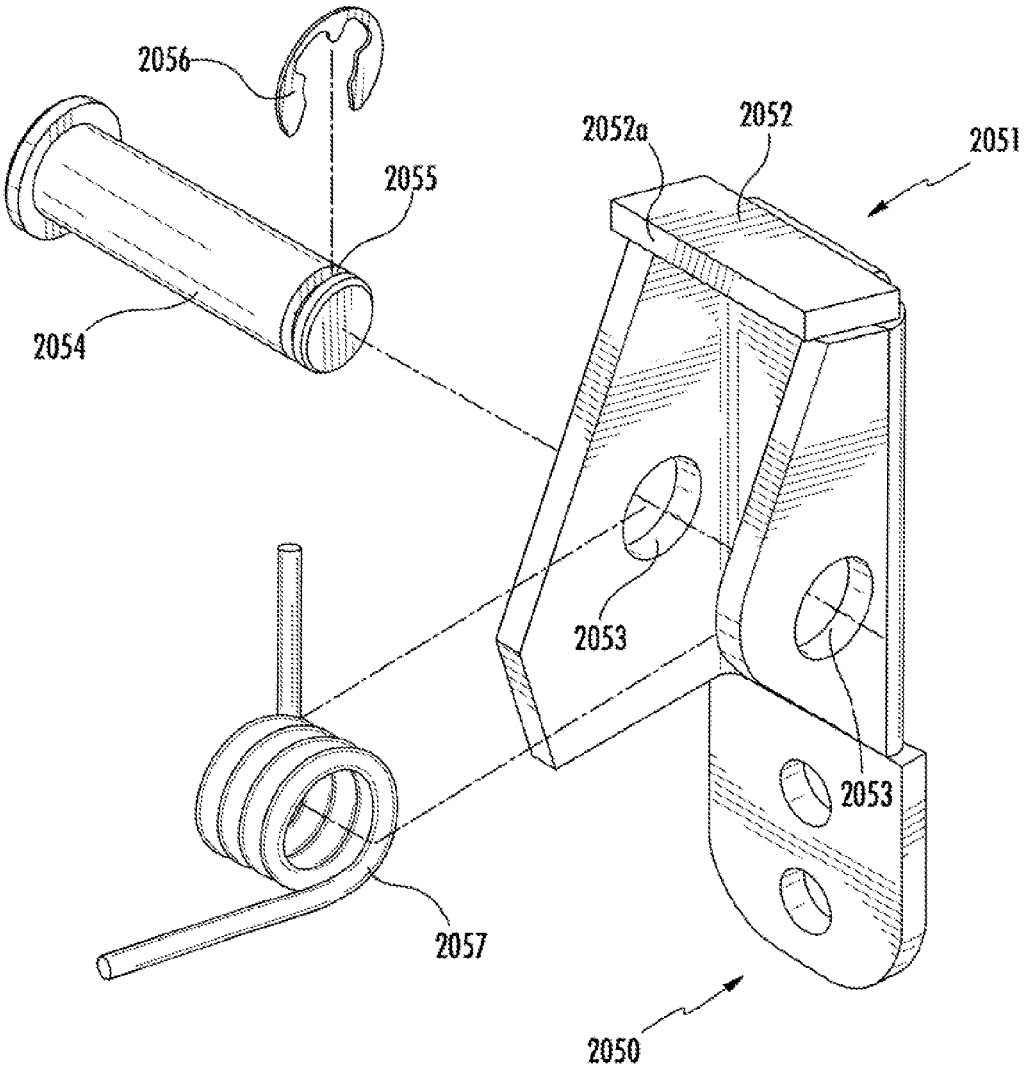

FIG. 12B is an exploded view of the magazine latch assembly of FIG. 12A.

DETAILED DESCRIPTION

Examples of the present disclosure will now be described more fully hereinafter with reference to the accompanying drawings, in which some, but not all examples of the disclosure are shown. Indeed, various exemplary aspects of the disclosure may be embodied in many different forms and should not be construed as limited to the examples set forth herein. Rather, these examples are provided so that this disclosure will be thorough and complete and will fully convey the scope of the disclosure to those skilled in the art. Like reference numerals refer to like elements throughout.

As used herein, "and/or" means any one or more of the items in the list joined by "and/or." Further, as used herein, the term "exemplary" means serving as a non-limiting example, instance, or illustration. Moreover, as used herein, the term, for example, or "e.g.," introduces a list of one or more non-limiting examples, instances, or illustrations.

Referring now to the figures, there is illustrated a firearm system, generally designated as reference number 1000, in accordance with one embodiment described herein. FIG. 1 illustrates a fully assembled firearm system, generally (1000). FIG. 2 illustrates an exploded view of the firearm system (1000), which can generally comprise or include, for example, a receiver assembly (1100), gas assembly (1200), bolt assembly (1300), stock (1400), magazine (1500), grip (1600), trigger assembly (1700), barrel (1800), muzzle brake (1900), and/or an ambidextrous safety assembly (2000) which can be operated from either a left or right side of the firearm system (1000) to select between a firing position and a safe position. The firearm system (1000) can comprise any combination of the foregoing elements or components not inconsistent with the objectives of the present invention.

Turning now to specific components, a firearm system (1000) can have a receiver assembly (1100). As illustrated in FIGS. 2, 3A, 3B, 3C, and 3D, a receiver assembly (1100) can comprise, consist, or consist essentially of an upper receiver (1110), lower receiver (1120), top rail cover (1130), takedown latch (1140), rear trunion (1150) and/or takedown latch spring (1160).

The upper receiver (1100) can comprise an indexing slot (1112) on at least one end, the indexing slot (1112) being operable to receive a gas cylinder (1260). The indexing slot (1112) can be shaped in such a manner that the gas cylinder (1260) can be inserted in a limited number of orientations, and such that when the gas cylinder (1260) is indexed or rotated after insertion into the indexing slot (1112), it is firmly locked into place with the upper receiver (1110). The upper receiver (1110) can further include a barrel receiving recess (1113) configured to receive a barrel (1800). In some cases, the barrel receiving recess (1113) can be threaded in order to permit the barrel (1800) to be secured once inserted, as illustrated in FIG. 3D.

The upper receiver (1110) can have one or more integrated tracks (1111*a*, 1111*b*) in order to permit the upper receiver (1110) to be slidably coupled with additional components of the firearm system (1000), such as an upper receiver cover (1130). The upper receiver (1110) can also include a plurality of interior tracks (1117*a*, 1117*b*, 1117*c*, 1117*d*) configured to receive components such as a bolt assembly (1300). The upper receiver (1110) can further include a plurality of pivot holes (1114) configured to receive a bolt, screw, or pin (1124) when the firearm system (1000) is assembled. As illustrated in FIGS. 7A and 7B, the upper receiver (1110) can further include castling notches (1115) which permit increased contact area between the upper receiver (1110) and lower receiver (1120). The upper receiver (1110) can further include or comprise a takedown slot or projection (1116) disposed on a distal end from the barrel receiving recess (1113) and configured to engage a takedown latch (1140).

A takedown latch (1140) as illustrated in FIG. 3C and FIG. 10A can operate as a safety plunger. When the takedown latch (1140) is spring biased by the takedown spring (1160) in the assembled position, an operator can press the takedown latch (1140), disengaging the takedown latch (1140) from the upper receiver (1110), permitting the upper receiver (1110) to pivot or rotate relative to the lower receiver (1120) along an axis defined by the pivot holes (1114), thereby "opening" the firearm system (1000), as illustrated in FIG. 10B. In some implementations, the takedown latch (1140) can be beveled and/or spring biased with a spring (1160) in a manner which permits the firearm system (1000) to be "opened" upon actuation or manipulation of the takedown latch (1140) while permitting the firearm system (1000) to be "closed" or assembled without the takedown latch (1140) being manually actuated or latched during a closing operation.

An upper receiver incorporating such features as discussed above facilitates a more rigid structure potentially leading to increased accuracy of the firearm system (1000) and lower production costs, due to fewer discrete parts and reduced assembly time. In an implementation as discussed herein, the effect of gas pressures on moving parts, as well as pressures from expanding metal as the firearm heats up during use, could potentially have reduced effect on the degradation of accuracy. Also, an implementation constructed as discussed herein could potentially experience relatively less harmonic vibration disturbances, increased accuracy, and also less warpage in the upper receiver rails due to stress and/or heat during operation. Also, an implementation constructed as discussed herein could include the incorporation of the feed ramp into the upper receiver, which may reduce assembly time of the firearm, and therefore potentially costs, and facilitates placement of the feed ramp in a desirable position for loading rounds, with the potential benefit of increasing the firearm's reliability as well as simplifying field maintenance.

Receiver assemblies (1100) can comprise a lower receiver (1120) as illustrated in FIGS. 3C, 7A, and 7B. The lower receiver (1120) can be of a "shell" type design, including two walls (1170, 1180) and a floor (1190). The lower receiver (1120) can include pivot holes (1121) on one end configured to receive a bolt, screw, or pin such as a pivot pin (1123) when the firearm system (1000) is assembled, permitting the receiver assembly (1000) to pivot or rotate relative to one or more other components of the firearm system (1000). The lower receiver can have a plurality of castling recesses (1122) corresponding to the number of castling notches (1115) on the upper receiver (1110). When assembled, the castling notches (1115) and castling recesses (1122) can operate to "lock" the assembly of the upper and lower receivers (1110, 1120) in a manner which inhibits sliding or movement of the two receiver portions relative to one another. The castling notches (1115) and castling recesses (1122) can further provide a "keying" orientation such that the upper and lower receivers (1110, 1120) are not assembled, or closed, in an improper alignment. The lower receiver (1120) can further comprise a plurality of recesses or holes of varying size in the wall portions order to accommodate certain other elements or components such as safety holes (1124) configured to receive a safety (2000), or to facilitate locking pins, bolts, or screws to be passed through the lower receiver (1120) in an assembled position. For example, the lower receiver (1120) can comprise rear trunion lock recesses (1123) configured to receive pins, bolts, or screws in a manner that can allow the rear trunion (1150) to be secured to the lower receiver (1120). Further, the bottom or "floor" of the lower receiver (1120) can comprise a number of generally rectangular or non-uniform holes or recesses (1126*a*, 1126*b*, 1126*c*), the rectangular or non-uniform holes or recesses being adapted to receive one or more of a magazine (1500) such as a first recess (1126*a*), grip (1600), and/or trigger assembly (1700) such as second and third recesses (1126*b*, 1126*c*).

Thus the present design facilitates the contact area between the upper and lower receivers and mechanically locks them together, which may provide increased strength to the overall design as a unit, as well as potentially reducing harmonic disturbances from vibrations transmitted through the upper and lower receivers. It also reduces the likelihood of an "open" firearm from being "closed" with improper alignment, due to error or mechanical damage (such as a damaged hinge pin,) and in that way serves as an added safety feature, in addition to increasing strength, reliability and accuracy.

Receiver assemblies (1100) can further comprise a rear trunion (1150). A rear trunion (1150) can be adapted to receive a stock (1400). In some implementations, a rear trunion (1150) can be adapted to accommodate conventional stocks (1400). For example, stocks (1400) which can be suitable for mating with the rear trunion (1150) can include folding, collapsing, and/or recoil absorbing stocks. The rear trunion (1150), as illustrated in FIG. 8A, can have a round recess or aperture (1151) configured to receive a stock (1400). The stock can be attached or affixed to the rear trunion (1150) by any means or structure not inconsistent with the objectives of the present invention. The rear trunion (1150) can further comprise at least one lower recess lock recess (1152) configured or adapted to receive a pin, bolt, or screw in a manner that can allow the rear trunion (1150) to the lower receiver (1120). The rear trunion (1150) can further comprise or include at least one bottom catch (1153) configured to engage a grip (1600). In some implementations, the rear trunion (1150) can be adapted to receive at least a portion of the takedown latch (1140). In such implementations, the rear trunion (1150) can include or comprise at least one takedown slot (1154) configured to receive the takedown latch (1140). Further, in such implementations, the rear trunion (1150) may have, on the second end, a beveled or inclined portion (1155) beneath the round recess or aperture (1151) permitting an operator to manually actuate or manipulate the takedown latch (1140). FIG. 10A illustrates an assembled firearm system (1000) according to such an implementation which permits the operator to actuate or manipulate the takedown latch (1140) from a lower portion of the firearm system (1000). The rear trunion (1150) can further comprise a plurality of side catches (1156) adapted to receive the upper receiver (1110). Such structure can provide a locking function when the upper receiver (1110) engages the rear trunion (1150) and lower receiver (1120) in the "closed" or assembled position as in FIG. 1.

Receiver assemblies can be adapted or configured to receive an ambidextrous safety assembly (2000) which can be operated from either a left or right side of the firearm system (1000) to select between a firing position and a safe position. Such an ambidextrous safety can comprise a first safety selector (2010) integral to a safety pin (2030) and a second safety selector (2020) separate from the safety pin (2030). The safety assembly (2000) can be connected to or in mechanical combination with a trigger assembly (1700).

Firearm systems can further comprise a gas assembly (1200). As shown in FIGS. 4A-4D, in some implementations, a gas assembly (1200) of a firearm system (1000) described herein can comprise, consist, or consist essentially of a throat (1210), valve (1220) comprising a profile (1222) and ridges (1223) disposed thereon, gas block (1230), retaining screws (1231*a*, 1231*b*), plunger spring (1232), plunger pin (1233), plunger (1234), gas roll pin (1235), piston (1240), piston roll pin (1241), spring washer (1242) and/or recoil spring (1250). The gas assembly or system (1200) can have a gas block (1230) which can be adapted to be mounted to the barrel (1800) by sliding it onto the barrel (1800) from the muzzle end of the barrel (1800). In some implementations, the gas block (1230) is adapted to receive the barrel (1800) in a first cylindrical receiver (1237*a*). Once in place, the gas block (1230) can be tightened into place by at least two retaining screws (1231*a*, 1231*b*) through the at least two retaining recesses (1231*c*, 1231*d*). The retaining screws (1231*a*, 1231*b*) can compress at least a portion of the gas block (1230) around the barrel (1800) in a clipping fashion. The gas block (1230) can have at least one gas port (1236) disposed therein which can align with a recess or aperture (not shown) in the barrel (1800). When the firearm system (1000) is fired, gas can pass through the recess or aperture from the barrel (1800) into the gas block (1230) directly above the barrel. Above the first cylindrical receiver (1237*a*), the gas block (1230) can comprise a second cylindrical receiver (1237*b*) configured or adapted to receive a gas tube (1260).

As previously mentioned, the propellant gas from firing a round of ammunition can pass into the gas block (1230) and subsequently into the gas tube (1260). The gas tube (1260) has an anterior side (1262) and a posterior side (1261). The gas tube (1260) can be secured into the firearm system (1000) by sliding the anterior side (1262) through the second cylindrical receiver (1237*b*) and resting the posterior side (1261) in the upper receiver (1110). The gas tube (1260) can be slightly beveled on at least one portion such that the gas cylinder (1260) is only insertable in a particular predetermined orientation. In such an implementation, the gas tube (1260) can then be rotated until it locks into the upper receiver (1110) by one or more lugs (not shown). A roll pin (1235), plunger (1234), and plunger spring (1232) can then be inserted into the gas tube (1260), thereby securing the cylinder in place at the upper receiver (1110). In such implementations, the cylinder can be free-floating at the gas block, thereby eliminating transfer of pressure from moving parts or from metal parts which may expand as a result of heat generated by firing the firearm system (1000). The plunger spring (1232) allows the plunger (1234) to be spring-biased, and can correspond to an indentation in the gas throat (1210) which can be secured on the anterior side (1262) to prevent the gas tube (1160) from being indexed unintentionally after placed in the lock position.

The gas system (1200) can further comprise a gas valve (1220) mounted in the gas tube (1260) at the gas throat (1210) at the anterior side (1262). The valve (1220) can be indexable and can include a plurality of holes or recesses (1221) which correspond to a plurality of holes or recesses (1211) in the throat (1210). In implementations where the valve (1220) is indexable, the valve (1220) can provide multiple positions to allow relatively greater and lesser amounts of propellant gasses to enter the gas tube (1260) from the barrel (1800). To provide indexability, the valve (1220) may comprise a raised profile (1222) that acts as a "key" for insertion which couples with an indented profile (1212) and can be turned or twisted. Ridges (1223) provide indication to an operator during turning or twisting of the valve (1220) in order to indicate when a particular gas position has been reached. For example, the gas system (1200) can be operated in a manner that provides a "high", "low" and/or "off" or "closed" positions with varying propellant gas levels. In an "off" or "closed" position, the valve prevents any gas from being transferred into the gas tube (1260), in which case the firearm system (1000) can operate by manual cycling as a repeater rather than by semi-automatic cycling.

The gas system (1200) can further comprise a piston (1240) having a notch (1240*a*) disposed therein and a piston head (1240*b*) at an end distal the notch (1240*a*), piston roll pin (1241), spring washer (1242), and recoil spring (1250). The recoil spring (1250) can be disposed in the gas tube (1260), and can be fastened to the piston (1240) by the spring washer (1242) and piston roll pin (1241), the piston roll pin (1241) being inserted into a recess in the piston (1240). The piston (1240) can operate as a guide for the recoil spring (1250). In such embodiments, the recoil spring can be disposed forward of the bolt assembly (1300).

Full assembly of the gas system (1200) can comprise mounting the gas block (1230), inserting the gas tube (1260) and indexing the gas tube (1260), locking the gas tube (1260) into the upper receiver (1110), inserting the piston (1240) and recoil spring (1250) into the gas tube (1260) and inserting and indexing the gas valve (1220). This potentially significantly increases the accuracy of the firearm. A spring loaded plunger on the gas block serves to keep the cylinder and gas valve properly indexed in locked position. In some implementations, the gas piston (1240) can comprise, consist, or consist essentially of a lightweight material. The gas piston (1240) can further comprise a slot or indentation (1240*a*) proximal to a first end, and can further comprise a piston head (1240*b*), widened plug, or stopper geometry on a second end distal to the first end.

Firearm systems (1000) can further comprise a bolt assembly (1300) as illustrated in FIGS. 9A, 9B, and 9C. A bolt assembly (1300) can comprise a charging handle (1310), a charging handle spring (1320), a bolt carrier (1330), a bolt (1340), an ejector spring (1350), an ejector (1360), and an ejector pin (1370). As illustrated in FIG. 9C, the bolt (1340) can have a complex polygonal design on at least one end which can be adapted to fit in a corresponding slot or track (1331) in the bolt carrier (1330). Such a configuration can permit the bolt to slide and rotate in unison, thereby engaging the ejector (1360) against a case (not shown) to eject the case. The ejector (1360) can be spring-biased in the bolt (1340) by an ejector spring (1350), the ejector and ejector spring (1360, 1350) being disposed in an ejector slot or recess (1341). The ejector (1360) can be locked into place within the bolt (1340) by the ejector pin (1370). The ejector pin (1370) can slide orthogonally into the bolt (1340) relative to the ejector (1360) through an ejector pin recess (1342) in the bolt (1340). The bolt (1340) can also comprise an extractor recess (1343) configured to receive an extractor (1371) operable to extract a shell or casing during cycling of the firearm system (1000).

The bolt assembly (1300) can comprise a charging handle (1310) which can lock the gas piston (1240) to the bolt carrier (1330). In some implementations, the charging handle (1310) is ambidextrous, and can be inserted from either a left or right side of the firearm system (1000) in order to lock the gas piston (1240) to the bolt carrier (1330). Further, the charging handle can operate as a type of locking pin and, when keyed into place, can fasten the piston (1240) to the bolt carrier (1330) without threads or welds of any kind. To this end, the charging handle (1310), as illustrated in the schematic representation in FIG. 6A, can contain a recessed plunger (1311) which is spring loaded by the spring (1320). The plunger (1311) can actuate a retaining catch assembly (1312), and can be removed by depressing the recessed plunger (1311) from the exterior with a thin, elongated object (not shown). The retaining catch assembly (1312) can include two adjacent cam lobes of differing heights, a first cam lobe and a second cam lobe (1313*a*, 1313*b*), one positioned on either side of a pivot point such as a roll pin (1315), in the retaining catch assembly. The plunger (1311) can have two recesses, a first recess (1314*a*) and a second recess (1314*b*) such that one or the other of the first and second cam lobes (1313*a*, 1313*b*) can be engaged depending on whether the plunger (1311) is in a depressed or undepressed position. When the plunger (1311) is in a normal position, the first cam lobe (1313*a*) is mated to a first recess (1314*a*) in the plunger (1311), and the second cam lobe (1313*b*) is depressed, fixing the retaining catch (1316) into position to retain the charging handle (1310) in the bolt carrier (1330). When the plunger (1311) is depressed, the first cam lobe (1313*a*) is unseated from the first recess (1314*a*), and the second cam lobe (1313*b*) is mated to the second recess (1314*b*). The unseating of the first cam lobe (1313*a*) and mating of the second cam lobe (1313*b*) can result in a pivot-type movement that moves the retaining catch (1316) into a depressed position, permitting removal of the charging handle (1310) from the bolt carrier (1330). As previously discussed, the design can be, in some implementations, ambidextrous such that the charging handle (1310) can be inserted from either the left or right of the upper receiver (1110). When actuated with propellant gas resulting from the firing of a round (not shown), the piston (1240) pushes the bolt carrier (1330) backwards as gas is released into the gas tube (1260), and the recoil spring (1250) returns the piston (1240) and the attached bolt carrier (1330) to the forward position to complete the firing/loading cycle.

Firearm systems (1000) can further comprise ambidextrous safety (2000) which can be operated from either a left or right side of the firearm system (1000) to select between a firing position and a safe position. As shown in FIG. 2, the safety (2000) includes a first lever (2010) for positioning on one side of the firearm system and a second lever (2020) for positioning on the other side of the firearm. The levers (2010, 2020) are connected to one another by a shaft (2030), which is carried in passage (1124) (FIG. 7A) in the lower receiver (1110) for pivoting movement between the firing and safe positions.

The foregoing bolt assembly or system design permits ejection of a spent case of a round of ammunition with a spring-loaded plunger located in the bolt face, which ejects the case as soon as the case mouth clears the chamber on extraction. Such a design can permit successful ejection even in the event of an incomplete cycle without necessity to clear the spent case from the action of the firearm system.

Other components may be present in a firearm system (1000) described herein, such as a trigger assembly (1700). A trigger assembly can comprise, consist, or consist essentially of a trigger guard (1710), a disconnector (1720), a trigger (1730), a hammer (1740), a hammer spring (1750), a trigger pin and hammer pin (1760), a barrel pin (1770), and/or a retaining or locking plate (2040). A disconnector (1720) can be operable to prevent the trigger assembly (1700) from being held in a firing position after a single actuation of the trigger (1730), thereby preventing fully automatic operation of the firearm system (1000). A retaining or locking plate (2040) can be adapted to retain pins, bolts, or the like into a fully assembled position.

FIGS. 11A-11C illustrate one implementation of a retaining or locking plate consistent with the foregoing description of a trigger assembly. A locking plate (2040) can comprise or include a body member (2040*a*), first engagement surface (2041), a second engagement surface (2042), a locking finger (2043) defined by a passage (2043*a*) in body member (2040*a*), and at least one recess (2044). A first engagement surface (2042) can be configured or shaped to engage a hammer (1740) of trigger assembly (1700) to retain a locking pin or protrusion of the hammer (1740). As illustrated in FIGS. 11A-11C, such functionality can be provided by a substantially C-shaped or substantially U-shaped arrangement of surfaces (2042, 2043). Further, a first engagement surface (2041) can have an opening to permit replacement or removal of the locking plate (2040) or the hammer (1740). Second engagement surface (2042) can be shaped or configured to engage and/or retain a safety or safety selector (2010). As illustrated in FIG. 11A, a second engagement surface (2042) can be concave or otherwise curved, and may comprise or include one or more protrusions configured to increase engagement surface area with a safety or safety selector (2010). More specifically, second engagement surface (2042) can engage a bottom portion of a safety or safety selector (2010), and a locking finger (2043) can be cantilevered from the locking plate (2040) and comprise or include at least one protrusion configured to engage the safety or safety selector (2010) from a top side. Locking plate (2040) can further comprise at least one recess (2044) configured to receive and/or engage a hammer pin (1760).

Locking plate (2040) can comprise or be formed from any material not inconsistent with the objectives of the present invention. In some embodiment, all or a portion of a locking plate (2040) is deformable. In such embodiments, a locking plate (2040) can be formed of a material that is elastically deformable so that one or more portions of a locking plate (2040), such as locking finger (2043) can be bent, twisted, or otherwise deformed and return to a predetermined form such as the implementation of FIG. 11A. In such embodiments, a locking plate (2040) can comprise or be formed from a metal or metal alloy such as spring steel. In certain other embodiments, all or a portion of a locking plate (2040) is rigid or substantially rigid. In such embodiments, a locking plate (2040) can be comprised or formed from any material providing rigidity for engaging and retaining components of a firearm system (1000) as described herein. For example, in some implementations, locking plates (2040) can comprise or be formed from aluminum, aluminum alloy, stainless steel, or combinations thereof.

In some implementations, firearm systems (1000) described herein can further comprise or include a magazine latch assembly (2050). A magazine latch assembly (2050) can comprise or include any components arranged in any manner not inconsistent with the objectives of the present invention. For example, in some embodiments, a magazine latch described herein can provide one or more contact or engagement surfaces adapted or configured to retain or engage a variety of magazine shapes, sizes, and/or orientations. A magazine latch assembly (2050), in some implementations, can include a magazine latch (2051), a spring-like member (2057), and a latch locking pin (2054). Further, in some embodiments, a latch locking pin (2054) can be adapted or configured to permit removable installation of the magazine latch assembly (2050). For example, a latch locking pin can define a recess (2055) disposed therein adapted to receive a clipping member (2056).

Turning now to specific components of a magazine latch assembly described herein, a magazine latch assembly (2050) can comprise or include a magazine latch (2051). A magazine latch, in some implementations, can comprise or include an enlarged flat engagement surface (2052). As illustrated in FIGS. 12A and 12B, an enlarged flat engagement surface (2052), in some instances, can be disposed at an angle relative to the magazine latch (2051). Further, in some cases, an enlarged flat engagement surface can define a leading edge (2052*a*). In certain implementations, the leading edge (2052*a*) can be positioned, adapted or configured to engage some magazines having a locking lug (1501) positioned relatively low on the magazine. In such implementations, rotation of the magazine latch (2051) can engage the leading edge (2052*a*) on certain magazine lugs (1501). In instances in which a magazine lug (1501) is positioned or shaped such that the leading edge (2052*a*) does not contact or retain the magazine upon initial rotation of the magazine latch (2051), the enlarged flat engagement surface (2052), upon further rotation, can engage or retain a magazine (1500) and/or magazine locking lug (1501). In this manner, the magazine latch (2051) can engage or retain a wider variety of magazines than firearm systems comprising or including a magazine latch with a single engagement surface or single engagement edge. A magazine latch (2051) can further define one or more through holes (2053) adapted to receive a rivet or latch locking pin (2054). Further, in some cases, the leading edge (2052*a*) of the flat engagement surface (2052) is adapted or configured to have a thickness or a width such that sharp edges of the leading edge (2052*a*) are substantially reduced or minimized in order to minimize wear on a magazine or magazine lug (1501) through repeated magazine insertion and removal.

Moreover, magazine latch assemblies (2050) described herein can comprise or include a latch locking pin (2054). In some implementations, the latch locking pin (2054) can be a rivet, bolt, or other single-use or permanent fastener. In other cases, however, the latch locking pin (2054) can be adapted to be removable and/or reusable. One such implementation is illustrated in FIGS. 11B, 12A and 12B. In the implementations illustrated, the latch locking pin (2054) defines a recess (2055) disposed about a circumference thereof. The recess (2055), in some implementations, can be adapted or configured to receive a clip or clipping member (2056). The clip (2056) can have any shape or configuration not inconsistent with the objectives of the present invention. For example, in some implementations, the clip (2056) is generally C or E-shaped. In such instances, the clip (2056) can comprise or be formed from spring steel such that engaging the open portion of the E-shape expands the clip (2056) until the clip is in a fully engaged position. In the fully engaged position, the clip (2056) can elastically reform or 'spring back' to enclose or engage the latch locking pin (2054). At least a portion of the clip (2056) can extend beyond or protrude from the recess (2055) such that movement of the latch locking pin (2054) is limited in at least one direction relative to the magazine latch (2051). Prior to engagement of the clip (2056), the latch locking pin (2054) can be inserted through the through holes (2053) in the magazine latch along with at least a portion of a trigger assembly (1700).

As illustrated in FIG. 11B, the latch locking pin (2054) can be adapted or configured to have a length and/or diameter such that two brackets (1711) affixed to a trigger guard (1710) of the firearm system, having through-holes disposed therein (not shown) can receive the latch locking pin (2054). The brackets (1711) can be parallel and disposed in facing opposition to one another, and the through-holes can be substantially aligned. For example, the latch locking pin (2054) can be configured such that when passed through a first through hole on a first bracket (1711), the latch locking pin (2054) is sufficiently long so as to pass through both through-holes (2053) on the magazine latch (2051) and through a second through hole in a second bracket (1711). The clip (2056) can then retain the latch locking pin (2054) in position to retain the magazine latch (2051). In such a configuration, the latch locking pin (2054) can restrict or limit lateral or side-to-side movement of the magazine latch (2051) relative to the brackets (1711) while permitting rotation of the magazine latch (2051). In this way, the latch locking pin (2054) can serve as an axis of rotation for the magazine latch (2051).

A magazine latch assembly (2050), in some implementations, further comprises a spring or spring-like member (2057). In some cases, the spring or spring-like member (2057) can have a central axis about which a spring is coiled. The central axis can define a recess having a diameter adapted or configured to receive the latch locking pin (2054). As illustrated in FIG. 12A, the spring-like member (2057) can bias the magazine latch in a locked position such that insertion of a magazine (1500) enacts rotation of the magazine latch (2051) about the latch locking pin (2054) relative to the brackets (1711), the spring-like member (2057) biasing the magazine latch (2051) against at least a portion of the magazine (1500), such as a magazine locking lug (1501) to retain the magazine (1500) in the magazine slot. A magazine latch (2051) can, in certain instances, further define or include an elongated portion opposite the flat engagement surface (2052) on an opposing side of the magazine latch (2051) relative to through holes (2053). In such a configuration, the magazine latch (2051) can be spring biased by the spring-like member (2057), and an operator can apply pressure or force to the elongated portion to rotate the magazine latch (2051) relative to the brackets (1711) on the trigger guard assembly (1710) in order to unlock or disengage the magazine latch (2051) from the magazine (1500).

FIG. 11B illustrates one implementation of a magazine latch assembly (2050) described herein in engagement with a magazine (1500). As illustrated in FIG. 11B, the magazine latch (2051) can engage the magazine (1500) along the flat engagement surface (2052). However, other orientations are also possible, such as the leading edge (2052*a*) of the flat engagement surface (2052) engaging the magazine (1500) consistent with the foregoing disclosure. In such implementations, a magazine latch assembly (2050) described herein can accommodate a wide variety of magazine configurations, orientations, and/or shapes.

Unless otherwise noted herein, other construction and/or operation details of one or more implementations of firearm system (1000) may be generally similar to that of standard AK-47 rifles, which are known to those of skilled in the art, and, accordingly, such details are not set forth herein in the interest of brevity and conciseness.

Various embodiments of the invention have been described in fulfillment of the various objects of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A firearm for firing a cartridge having a projectile, the firearm comprising:
- a receiver assembly adapted to receive the cartridge;
- a bolt assembly including a firing device operable to fire the cartridge;
- a barrel adapted to receive the projectile after the cartridge is fired;
- a gas assembly including a gas tube; and
- the receiver assembly including:
  - an upper receiver portion defining a longitudinal axis and an indexing slot operable to receive the gas tube and including:
    - at least one integrated exterior track extending generally parallel to the longitudinal axis;
    - at least one interior track extending generally parallel to the longitudinal axis;
  - a lower receiver portion, the upper receiver portion and the lower receiver portion being pivotally connected to one another;
  - a rear trunion adapted to receive a firearm grip and configured to removably connect to the lower receiver portion; and
  - an upper receiver cover,
- wherein the upper receiver cover is adapted to slidably couple with the at least one integrated exterior track; and
- wherein the bolt assembly is adapted to slidably couple with the at least one interior track.

2. The firearm of claim 1, wherein the indexing slot is adapted to receive the gas tube in a limited number of orientations.

3. The firearm of claim 2, wherein the gas tube is configured such that rotating the gas tube within the indexing slot operates to axially lock the gas tube to the upper receiver portion.

4. The firearm of claim 1, further comprising:
- the upper receiver further defining castling notches; and
- the lower receiver defining castling projections adapted to engage the castling notches.

5. The firearm of claim 1, further comprising a takedown latch operable to lock the upper receiver, the lower receiver, and the rear trunion into a closed position.

6. The firearm of claim 5, further comprising:
- the upper receiver further defining a takedown slot adapted to engage the takedown latch.

7. The firearm of claim 1, wherein the rear trunion is adapted to receive a stock.

8. An apparatus for use in a firearm, the firearm being operable for firing a cartridge having a projectile and having a firing device operable to fire the cartridge and a barrel adapted to receive the projectile after the cartridge is fired, the apparatus comprising:
- a gas assembly including a gas tube; and
- a receiver assembly adapted to receive the cartridge and including:
  - an upper receiver portion defining a longitudinal axis and an indexing slot operable to receive the gas tube and including:
    - at least one integrated exterior track extending generally parallel to the longitudinal axis;
    - at least one interior track extending generally parallel to the longitudinal axis;

a lower receiver portion, the upper receiver portion and the lower receiver portion being pivotally connected to one another;

a rear trunion adapted to receive a firearm grip and configured to removably connect to the lower receiver portion; and an upper receiver cover, wherein the upper receiver cover is adapted to slidably couple with the at, least one integrated exterior track.

9. The apparatus as defined in claim 8, further comprising:

a bolt assembly connected to the firing device; and wherein the bolt assembly is adapted to slidably couple with the at least one interior track of the upper receiver portion.

* * * * *